US012339020B1

(12) United States Patent
Brooks

(10) Patent No.: US 12,339,020 B1
(45) Date of Patent: Jun. 24, 2025

(54) SMART CONTROLS FOR HYBRID REFRIGERATION CYCLES

(71) Applicant: Barry Richard Brooks, Pilot Hill, CA (US)

(72) Inventor: Barry Richard Brooks, Pilot Hill, CA (US)

( * ) Notice: Subject to any disclaimer, the term of this patent is extended or adjusted under 35 U.S.C. 154(b) by 0 days.

(21) Appl. No.: 18/989,373

(22) Filed: Dec. 20, 2024

Related U.S. Application Data

(60) Provisional application No. 63/613,468, filed on Dec. 21, 2023.

(51) Int. Cl.

| | |
|---|---|
| ***F24F 11/47*** | (2018.01) |
| ***F24F 11/38*** | (2018.01) |
| ***F24F 11/52*** | (2018.01) |
| ***F24F 11/63*** | (2018.01) |
| *F24F 110/10* | (2018.01) |

(52) U.S. Cl.
CPC ..... *F24F 11/47* (2018.01); *F24F 11/38* (2018.01); *F24F 11/52* (2018.01); *F24F 11/63* (2018.01); *F24F 2110/10* (2018.01)

(58) Field of Classification Search
CPC .. F24F 11/47; F24F 11/38; F24F 11/52; F24F 11/63; F24F 2110/10; F24F 11/46; G05B 15/02; G05B 13/048; F24D 12/02; F01K 3/12
See application file for complete search history.

(56) References Cited

U.S. PATENT DOCUMENTS

| | | | | |
|---|---|---|---|---|
| 8,620,841 | B1 | 12/2013 | Filson et al. | |
| 9,286,781 | B2 | 3/2016 | Filson et al. | |
| 9,609,462 | B2 | 3/2017 | Warren et al. | |
| 10,598,418 | B2 | 3/2020 | Shen et al. | |
| 10,830,503 | B2 | 11/2020 | Kopko | |
| 11,156,997 | B2 | 10/2021 | Casa | |
| 11,353,226 | B2 | 6/2022 | Park et al. | |
| 11,378,938 | B2 | 7/2022 | Cella et al. | |
| 11,609,553 | B2 | 3/2023 | Cella et al. | |
| 12,061,003 | B2 | 8/2024 | Miller et al. | |
| 2012/0152232 | A1 * | 6/2012 | Pedersen | F24D 18/00 165/10 |
| 2016/0321564 | A1 | 11/2016 | Imahara et al. | |

(Continued)

FOREIGN PATENT DOCUMENTS

| | | |
|---|---|---|
| CN | 200965296 | 10/2007 |
| DE | 102015219199 A1 * | 4/2017 |

*Primary Examiner* — Alicia M. Choi

(57) ABSTRACT

The disclosed embodiments disclose techniques for controlling a hybrid space-conditioning system (HSCS) that comprises a two-phase fluid circuit and an energy-exchange resource connected in parallel to the two-phase fluid circuit. During operation, a computing mechanism tracks operating characteristics for the system. The computing mechanism receives a temperature forecast and uses tracked characteristics and forecasts to predict watt usage for a subsequent time interval and a beneficial time interval during which the two-phase fluid circuit will operate with high efficiency. The computing mechanism charges the energy-exchange resource during the beneficial time interval, and then reduces the watt usage of the HSCS by leveraging the charged energy-exchange resource during a time interval in which the two-phase fluid circuit is predicted to operate inefficiently.

17 Claims, 13 Drawing Sheets

(56) References Cited

U.S. PATENT DOCUMENTS

| | | | | |
|---|---|---|---|---|
| 2017/0227299 | A1* | 8/2017 | Eustis | F25B 30/02 |
| 2018/0142914 | A1 | 5/2018 | Seo et al. | |
| 2018/0195752 | A1 | 7/2018 | Sasaki et al. | |
| 2019/0219308 | A1* | 7/2019 | Hamstra | F24T 10/00 |
| 2022/0102998 | A1* | 3/2022 | Xu | H02J 7/0071 |
| 2022/0205668 | A1* | 6/2022 | Bell | F24F 11/89 |
| 2024/0044521 | A1* | 2/2024 | Konowalczyk | F24H 15/277 |
| 2024/0254897 | A1* | 8/2024 | O'Donnell | B63H 11/00 |

* cited by examiner

SMART CONTROLS FOR HYBRID REFRIGERATION CYCLES

RELATED APPLICATION

This application claims priority under 35 U.S.C. § 119 (e) to U.S. Provisional Patent Application No. 63/613,468, by inventor Barry Richard Brooks, entitled "Integrating Applications and Methods of Self-Learning and Reasoning Smart Controls for Aftermarket Hybrid Refrigeration Cycles," filed 21 Dec. 2023. The contents of all of the above-referenced applications are hereby incorporated by reference.

BACKGROUND

Field of the Invention

This disclosure generally relates to techniques for improving the control of heating and refrigeration cycles. More specifically, this disclosure relates to smart controls for hybrid refrigeration cycles.

Related Art

The process of cooling an interior space is predominantly achieved using a phase change refrigerant flowing within a piping loop. The most widely manufactured system of market choice is referred to as an air conditioning appliance. The refrigerant loop consists of a compressor with a high and low pressure side, an interior energy-exchange device, an exterior energy-exchange device, and a pressure differentiating valve to create balancing of the high and low pressure sides with the compressor inlet and outlet. Adding a reversing valve at the discharge of a compressor facilitates reversing flows of refrigerant to shift the transfer of energy within the loop to also allow heating of an interior space. Appliances that offer both cooling and heating are referred to as heat pumps. The interior and exterior energy exchange devices typically expose finned tubing to the surrounding air for maximum heat transfer. A variation of the above appliances utilize ground and/or water as an energy source or sink for cooling and heating appliances.

There have been limited improvements to the control and operation of such devices since their introduction into residential and commercial markets. In an effort to improve energy efficiency and electrification of such systems, manufacturers of cooling-only units and heat pumps offer two-speed and variable speed systems as an alternative to manufactured single speed compressors. Otherwise, the direction of refrigerant flows and the speed of compressor and heat-exchange fans are typically the only variables that the current technology offers. Unfortunately, ambient-air-based cycles (also referred to as air-source refrigeration cycles) have a known drawback when ambient air serves to absorb source energy in peak summer conditions or serves as an energy sink during peak winter conditions). Specifically, the cycle becomes less efficient as outdoor temperatures rise or fall in relation to indoor thermostat set points. For example, additional wattage is typically required to provide cooling during afternoon periods in the summer or heating during winter night time hours. These time periods decrease operating efficiency, and the increased energy demand can strain utility energy sources.

Hence, what is needed are techniques for managing heating and cooling solutions without the above-described problems of existing techniques.

SUMMARY

The disclosed embodiments disclose techniques for controlling a hybrid space-conditioning system (HSCS) that comprises a two-phase fluid circuit and an energy-exchange resource connected in parallel to the two-phase fluid circuit. During operation, a computing mechanism tracks operating characteristics for the two-phase fluid circuit and the energy-exchange resource. The computing mechanism receives a temperature forecast for a subsequent time interval, and uses the tracked characteristics and the temperature forecast to determine a predicted watt usage for the subsequent time interval and a beneficial time interval in the subsequent time interval during which the two-phase fluid circuit will operate with high efficiency. The computing mechanism configures the two-phase fluid circuit to charge the energy-exchange resource during the beneficial time interval, and then subsequently reduces the watts used by the HSCS by leveraging the charged energy-exchange resource during portions of the subsequent time interval during which the two-phase fluid circuit is predicted to operate inefficiently.

In some embodiments, the energy-exchange resource comprises an energy source or an energy sink added on as a retrofit to a previously-installed system that includes the two-phase fluid circuit and a host thermostat. The HSCS includes a control system that tracks and overrides the operating signals of the host thermostat and the two-phase fluid circuit to integrate and leverage the capabilities of the energy-exchange resource, thereby reducing the watts used by the two-phase fluid circuit. More specifically, the control system and the energy-exchange resource improve the energy efficiency of the HSCS by reducing the watts used by the two-phase fluid circuit during the inefficient interval, which is the timeframe in which the control system predicts the two-phase fluid circuit would otherwise operate at the least efficient operating condition.

In some embodiments, the two-phase fluid circuit is a bi-directional heat-pump system or a unidirectional air-conditioning system, and the energy-exchange resource charges using the air-centric circuit of the two-phase fluid circuit in a timeframe in which the two-phase fluid circuit would otherwise not run to take advantage of a favorable ambient-air temperature that facilitates low-watt charging of the energy-exchange resource.

In some embodiments, the control system tracks and analyzes the operating parameters of a compressor and an external heat-exchange coil in the two-phase fluid circuit by: (1) measuring a temperature difference between the inlet and the outlet of the compressor to determine operation and direction; and (2) measuring a temperature for an external heat-exchange coil to determine the watts being consumed. The control system compares a set of parameters and specifications for the compressor and the external heat-exchange coil to determine correctness and efficiency of operation. Furthermore, the control system compares the efficiency of operation for the bi-directional two-phase fluid circuit components with the efficiency of HSCS operation when leveraging the charged energy-exchange resource.

In some embodiments, the control system leverages sensors that: (1) track an internal temperature of a structure being climate-conditioned by the HSCS; (2) the external air temperature for a compressor of the two-phase fluid circuit; and (3) a temperature for the energy-exchange resource. The control system uses the internal temperature, external air temperature, third temperature, the tracked characteristics and the temperature forecast to determine when to leverage the energy-exchange resource as an alternate temperature sink for an air-centric temperature sink that is used by the two-phase fluid circuit.

In some embodiments, the control system: (1) determines the watt usage of the HSCS when operating using the air-centric temperature sink across a range of temperatures; (2) determines the watt usage of the HSCS when operating using the energy-exchange resource as the alternate temperature sink across a range of states and conditions for the energy-exchange resource; and (3) determines an additional overhead and a wattage cost associated with charging and accessing the energy-exchange resource. A decision by the control system to leverage the charged energy-exchange resource involves determining that the wattage reductions associated with using the charged energy-exchange resource outweigh the additional overhead and the wattage cost.

In some embodiments, the control system receives a manufacturer performance curve describing the efficiency of the two-phase fluid circuit across a range of operating conditions and a set of characteristics describing the parameters of the energy-exchange resource. The control system compares the manufacturer performance curve with the tracked operating characteristics for the two-phase fluid circuit to adjust the manufacturer performance curve to the specific environment of the structure. Furthermore, the control system compares the set of characteristics with the tracked operating characteristics for the energy-exchange resource to model the tracked performance of the energy-exchange resource in the specific environment of the structure.

In some embodiments, the control system compares the tracked performance of components of the HSCS with received manufacturer performance and specification information to detect unusual component behavior that may lead to system damage. Upon detecting an issue, the control system flags an alert to a user of potential issues for the HSCS and operates the HSCS in a default mode of the previously-installed system and the host thermostat to ensure that there is no damage to the previously-installed system and the HSCS.

In some embodiments, reducing the watts used by the HSCS involves analyzing the temperature forecast for the subsequent time interval, the adjusted manufacturer performance curve, and the modeled performance of the energy-exchange resource to determine: (1) a specific charging interval within the subsequent time interval during which to charge the energy-exchange resource; and (2) a specific usage interval within the inefficient interval during which to leverage the charged energy-exchange resource to minimize the watt usage of the HSCS.

In some embodiments, the control system determines a current thermal capacity and a maximum thermal capacity for the energy-exchange resource. The control system then determines that the current thermal capacity is sufficient for the inefficient interval, but that the current thermal capacity is less than the maximum thermal capacity and that additional charging can be performed during the beneficial time interval. The control system calculates a likelihood of variation from the temperature forecast based on tracked previous forecasts and actual measured temperatures over past operation, and performs an additional amount of charging of the energy-exchange resource during the beneficial time interval based on the likelihood to further improve efficiency of the HSCS if actual temperatures deviate from the temperature forecast. This decision may involve a cost-benefit analysis of the additional overhead cost of the additional charging in comparison with the benefits of improved efficiency due to harsher conditions than forecast.

In some embodiments, the subsequent time interval is a 24-hour day, and the control system determines from the temperature forecast, a climate zone associated with an install location for the HSCS, and/or a known time and date that the HSCS is operating in a winter season. The control system further determines that the winter season is associated with warmer daytime temperatures and cooler nighttime temperatures that require heating. Given these conditions, the control system warm-charges the energy-exchange resource during the warmest predicted daytime temperatures to minimize the watt usage for an ambient-air-exchange mechanism in the two-phase fluid circuit and then subsequently leverages the charged energy-exchange resource as an energy sink to reduce watt usage while using the HSCS to heat the structure during the coldest predicted evening temperatures of the inefficient interval.

In some embodiments, the subsequent time interval is a 24-hour day, and the control system determines from the temperature forecast, a climate zone associated with an install location for the HSCS, and/or a known time and date that the HSCS is operating in a summer season. The control system further determines that the summer season is associated with warmer daytime temperatures that require cooling and cooler nighttime and morning temperatures. Given these conditions, the control system cool-charges the energy-exchange resource during at least one of the coolest predicted nighttime and morning temperatures to minimize the watt usage for an ambient-air-exchange mechanism in the two-phase fluid circuit and then subsequently leverages the charged energy-exchange resource as an energy sink to reduce watt usage while using the HSCS to cool the structure during the warmest predicted daytime temperatures of the inefficient interval.

In some embodiments, the subsequent time interval is a 24-hour day, and the control system determines from the temperature forecast, a climate zone associated with an install location for the HSCS, and/or a known time and date that the HSCS is operating in a shoulder season. The control system determines expected temperature values for the subsequent time interval from the temperature forecast to determine predicted daytime and nighttime temperatures, and determines from the predicted temperatures at least one of the heating or cooling needs for the structure over the subsequent time interval. The control system further determines a current state of the energy-exchange resource, and uses the current state to calculate and compare the watt usage benefits of warm-charging the energy-exchange resource vs cool-charging the energy-exchange resource for the subsequent time interval. Based on the outcome of this comparison, the control system determines a charging direction and selects a corresponding beneficial time interval and an inefficient interval for this charging direction to respectively charge and then use the energy-exchange resource to minimize the watt usage of the HSCS over the subsequent time interval. Note that during the shoulder season the charging type for the energy-exchange resource may change on a daily basis.

In some embodiments, the subsequent time interval is a multi-day interval, and the control system uses the temperature forecast to determine multi-day temperature trends for the subsequent time interval. The control system then uses the tracked characteristics for the energy-exchange resource and the set of characteristics describing the parameters of the energy-exchange resource to model an energy loss for the energy-exchange resource over the multi-day interval. Upon determining that the calculated watt reduction benefits of pre-charging the energy-exchange resource are larger than the calculated energy loss, the control system takes advantage of beneficial near-term temperature conditions to pre-charge the energy-exchange resource to reduce wattage usage for the HSCS over multiple subsequent days.

In some embodiments, the control system tracks one or more external sensors that indirectly detect signals sent from and received by the host thermostat, and then adjusts a charging operation for the energy-exchange resource in response to a requested operation detected via the tracking of the host thermostat.

DETAILED DESCRIPTION

Figure 1:
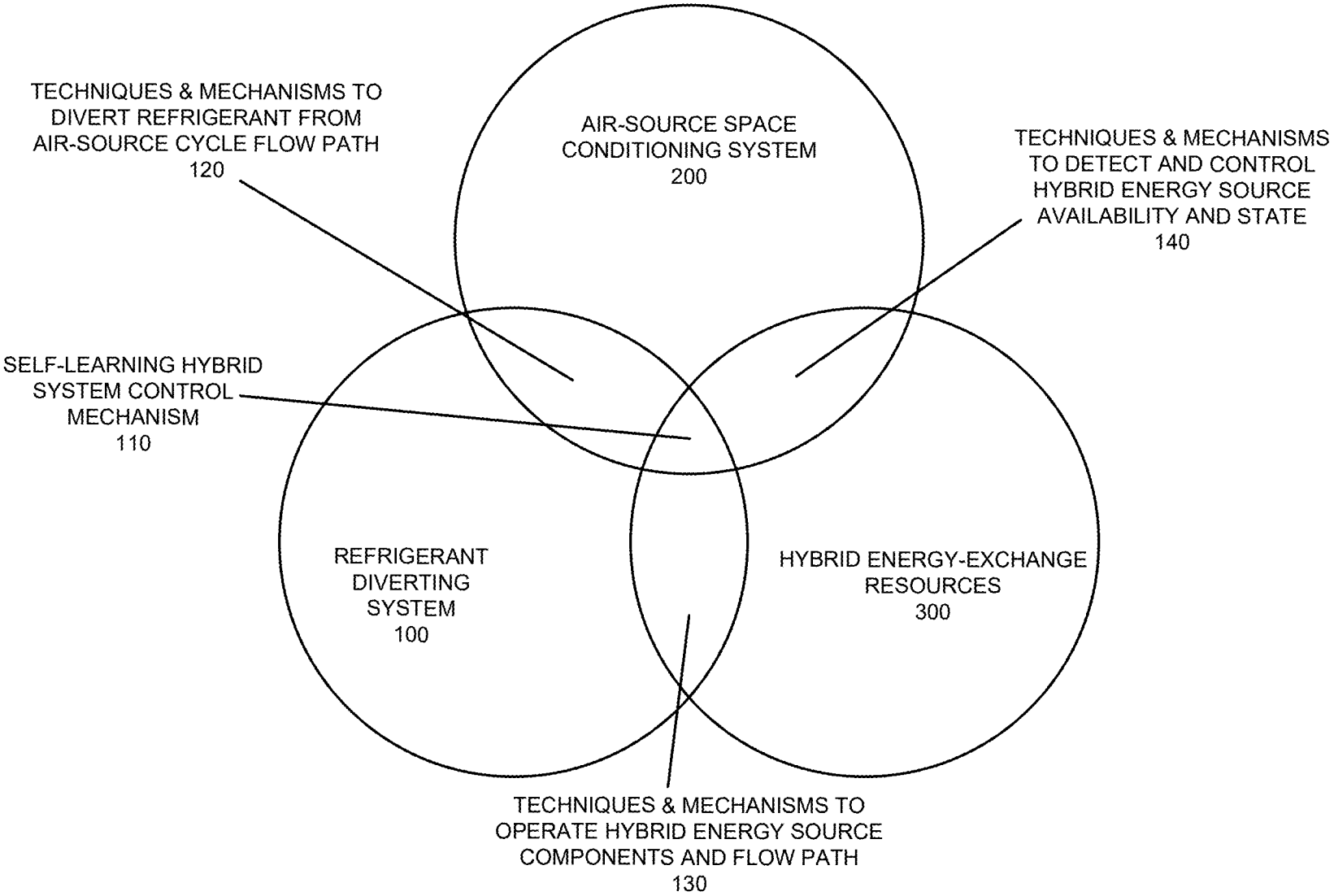
FIG. 1 illustrates a Venn diagram that shows the relationship between three process features that comprise a hybrid refrigeration system and the disclosed control techniques in accordance with an embodiment.

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

The data structures and code described in this detailed description are typically stored on a non-transitory computer-readable storage medium, which may be any device or non-transitory medium that can store code and/or data for use by a computer system. The non-transitory computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing code and/or data now known or later developed.

The methods and processes described in the detailed description section can be embodied as code and/or data, which can be stored in a non-transitory computer-readable storage medium as described above. When a computer system reads and executes the code and/or data stored on the non-transitory computer-readable storage medium, the computer system performs the methods and processes embodied as data structures and code and stored within the non-transitory computer-readable storage medium.

Furthermore, the methods and processes described below can be included in hardware modules. For example, the hardware modules can include, but are not limited to, application-specific integrated circuit (ASIC) chips, a full-custom implementation as part of an integrated circuit (or another type of hardware implementation on an integrated circuit), field-programmable gate arrays (FPGAs), a dedicated or shared processor that executes a particular software module or a piece of code at a particular time, and/or other programmable-logic devices now known or later developed. When the hardware modules are activated, the hardware modules perform the methods and processes included within the hardware modules.

Heating and Cooling Systems

Some embodiments of the present invention involve techniques for monitoring and controlling a refrigerant diversionary system connected to an air-source air-conditioner or heat pump that is coupled to additional methods of heat transfer embodied within defined multiple cycles. Note that while air-source appliances are common and therefore will be the focus of the examples disclosed in the following sections, the disclosed techniques are not limited to air-source appliances and can be applied to a range of other systems as well. The following disclosed embodiments illustrate a range of exemplary controlling methods and a number of variations of their advantage in order to set forth the best modes contemplated for the invention. The disclosed embodiments should not be considered a limitation when interpreting the scope of the appended claims. The terms host- or receiving circuit may be used interchangeably for the purpose of clarity when describing an air-conditioning or heat-pump piping loop with controllable components. The terms temperature, heat, energy exchange, and energy storage may be used interchangeably for the purpose of clarity when describing a source of cold or hot conditions.

Some embodiments of the present invention comprise a transformational control improvement that improves air-conditioning and heat-pump cycle efficiency for residential, apartment, and light-commercial structures by accessing auxiliary sources of energy via diversionary piping and control valves. Some embodiments include the use of self-learning and reasoning control techniques to isolate and operate a refrigeration cycle from indoor conditioning when energy is being stored. Some embodiments also allow sourcing energy directly and isolating the condenser, for example. Note that while some of the disclosed embodiments involve techniques for controlling additional circuits and controls that are added on (e.g., retrofitted) to an existing host conditioning system, many of the disclosed monitoring and control techniques can also be applied to an integrated system that is being newly installed.

The predominant method used to cool only in the application of an air-conditioning cycle or the cooling and heating cycle of a heat pump typically relies on outdoor ambient conditions for releasing or absorbing energy. The primary mechanical components of a cooling-only cycle are a compressor, an indoor supply air fan, an indoor heat exchange mechanism, an outdoor heat-exchange fan, an outdoor heat-exchange mechanism, and a refrigerant-feed-control mechanism. The primary mechanical components required for a heat pump in addition to the components for cooling-only are the addition of a coolant reversing mechanism, a second refrigerant feed-control mechanism, and a reversing check valve associated with each of the two refrigerant-feed-control mechanisms. The control mechanisms for a cooling-only system or a heat-pump system range in complexity from a simple binary signal output by a thermostat (typically located indoors) for starting single-speed or two-speed component motors to more complex control methods. Manufacturers of refrigeration cycle systems offer variable-speed drive on compressor motors and fan motors in the effort to reduce watt consumption.

Manufacturers of interior thermostatic control switching devices (thermostats) offer variations as to when to initiate cooling and heating. Thermostat manufacturers have advanced their technology to include self-learning and reasoning software for interior environment control. Modern techniques include learning the habits of occupants to determine the start and stop times of the refrigeration loop cycle with compressor operation. Smart thermostats offer self-learning and user habit capabilities for indoor environmental control that complement systems with variable speed motors.

The efficiency of air-source refrigeration cycles is subject to outside environmental conditions at any given time. During peak summer heat conditions, compressors providing cooling will draw higher amperages while increasing discharge temperatures of the refrigerant for efficient energy exchange to ambient air. Conversely, a heat pump that is providing heating must operate longer during winter periods while absorbing limited energy from ambient air, and may need to also leverage auxiliary heating strips. Therefore, the cost and demand for electricity is typically high during these two peak periods of the year.

The flow of refrigerant in a refrigeration cycle can be used to determine the operation status of the components of the cycle. Operation modes can be determined by temperature and pressure sensors that indicate rises and differentials in temperature and pressure. For example, the operation cycle of a heat-pump mode can be determined measuring a rise in temperature at the outlet on the compressor. Determining the higher temperature of the reversing valve outlet indicates whether the operation cycle is in heating or cooling mode. Additional methods of determining the operation of the original cycle involve measuring current and voltage to individual electrical components of a conditioning system. In some embodiments, sensor data and knowledge of system behavior can be used to interrupt manufacturer control signals and control the motors and behavior of a refrigeration cycle independently from normal indoor thermostat start/stop initiation.

In addition to the peak summer and winter periods, many geographic regions in the course of a year typically have two "shoulder periods." In the context of air-source air conditioners and heat pumps, these are periods during which outdoor ambient conditions are the same, or near the same, as the indoor thermostat set point. Indoor and outdoor temperatures may balance within a 24 hour period. In some climate zones shoulder periods may be measured in days while in other climate zones they may be measured in months. During longer shoulder periods a shift between cooling and heating demand may occur with moderate highs and lows. It is during this period when an air-source refrigeration cycle is most efficient. An air-source refrigeration cycle can achieve even greater efficiency when during warm periods the outdoor heat exchanger has an energy sink temperature lower than the indoor set point. Conversely, during cool periods the heat pump cycle can achieve greater efficiency when the external heat source is higher than the indoor thermostat set point. Under both conditions the cycle compressor operates at the manufacturer's highest coefficient of performance (COP) while drawing near no load amperage. This is near equivalent to a variable speed motor operating at its lowest speed. Also during these periods compressor and fan motor wattage loads may, therefore, decrease further when variable speed motors are included.

Governmental policies relating to climate change and the implementation of sustainable use of electric appliances within homes and light commercial buildings are now focused on electric demand shifts and system optimization operation for air-source cooling and heating cycles. Over 90% of cooling-only and heat-pumps systems are common air-to-refrigerant heat exchange systems. The least common are referred to as packaged units whereas the most common are referred to as split system units where primary components are separated.

One problem facing the desire of the policy makers to shift demand loads and operate a refrigeration cycle at optimum efficiency times during a 24-hour period arises because manufacturers of common air-source air conditioners and heat pumps do not include mechanisms to accomplish this capability (e.g., by adding sensors or voltage controls to their refrigeration cycle and its components in order to accommodate additional heat exchange methods). New technical approaches to address such policy issues leverage aftermarket add-on hybrid systems that allow access to discretionary sources of thermal sources or storage. Hybrid systems may include efficiency improvement components for cooling only, heating only, or a combination of both. However, the operational and predictive software of an add-on diversionary system would typically need overriding control of the original manufactured refrigeration host-cycle components to be able to selectively select and optimize host system performance. Some exemplary embodiments of an add-on hybrid system can be found in Brooks (U.S. patent application Ser. No. 18/218,044, included by reference); in some embodiments, enhanced control mechanisms are employed to achieve optimum efficiency of a hybrid cycle system.

In addition, policy makers involved with climate change have developed programs that are difficult to follow regarding the over-use of refrigerants. Field technicians often over-charge air-source heating and cooling systems due to lack of skill or diagnostic data. While companies manufacture devices for measuring system charging, these devices are not integrated into any diagnostic system by manufacturers. In some embodiments, the sensing capabilities of a control mechanism can be leveraged to compare anticipated system behavior with actual system measurements during operation to detect refrigerant over-/under-charging.

In some embodiments of the present invention, comprehensive control mechanisms leverage predictive self-learning and reasoning techniques that control an add-on diversionary system and can override a manufactured refrigeration system to cycle electro-mechanical components independently from user thermostatic control. For instance, by using a data-layered software architecture exact watt usage and reduction can be obtained through an independent energy receiving and retention system that is accessed separately from user demand but in conjunction with the manufactured system host cycle. In some embodiments, added temperature or voltage sensing methods allow these control mechanisms to make such computations. A computing mechanism may access data associated with such methods in conjunction with software libraries and/or other platforms to aid in computations and firmware control.

In some embodiments, a software control logic application uses sensors and voltage interruption devices to determine and control the operation and the condition of operation of a manufactured refrigeration cycle commonly used in cooling and heating of interior spaces. By knowing the operation of an air-source heat pump, for example, additional heat exchange devices interconnected with the cycle can be used to improve the efficiency of a manufactured cycle. In such embodiments, the disclosed mechanisms can either take control of the operation of a manufactured cycle when it is advantageous for access to one or more interconnecting heat exchangers or energy storages or default back to the manufactured cycle when it is not. The disclosed techniques comprise controlling techniques for any type of hybrid host refrigeration cycle and diversionary piping arrangement system affixed to the host cycle, allowing for additional discretionary heat exchange for efficiency improvement.

There are many points within a manufactured heat pump cycle where add-on external piping temperature sensing can indicate compressor operation and operating conditions. The following examples of sensor measurements provide the basis for more complicated computations and self-learning decision trees: (1) temperature difference from inlet to outlet of compressor indicates operation, (2) temperature difference from inlets and outlets of a reversing valve indicates whether a heat pump is in cooling or heating, and (3) temperature of the external heat exchange coil relates to the watts being consumed by the compressor during both summer and winter. Operating pressures can also be determined using tables derived from previous specifications and/or measurements (e.g., within a software library). Such data may also be provided by manufacturers in the form of performance curves or tables based on the refrigerant used and component characteristics, which may model performance based on a range of ambient conditions, ambient temperature and humidity (e.g., air enthalpy), etc.

Manufacturers of thermostats and manufactured refrigeration-cycle mechanical components typically utilize low voltage wiring and relays. Analog electric relays are commonly used by manufacturers of single- and two-speed compressors and single-speed air moving fans on heating and cooling systems. Reversing valves on heat pumps also are low voltage control. The controls of these electrical components within the manufactured refrigeration cycle can be overridden by using simple "flip-flop" relays to induce operation independent of the thermostat. Variable frequency drive (VFD) components installed by manufacturers for controlling compressors and air-moving fans use variable frequency or voltage to follow the demand load. By following the demand load, less wattage is consumed during less-than-peak conditions. However, in some embodiments, analog relays can be installed to bypass frequency-drive systems. Therefore, internal thermostats and starting relays can be can be bypassed in order to operate a compressor or heat exchange fan(s) independently, either collectively or separately.

In some embodiments, hybrid diversionary products add additional components to refrigeration cycles that allow additional heat exchange and improve the coefficient of performance (COP) of a refrigeration cycle. Such products typically include additional fluid control devices and a control system that can control the additional components and maximize efficiency. More specifically, in such embodiments the control system needs to encompass: (1) typical air-conditioning or heat-pump cycle components; (2) an additional diversionary hybrid piping and valve system; and (3) controlled direct and/or indirect access to auxiliary energy sources.

Figure 10:
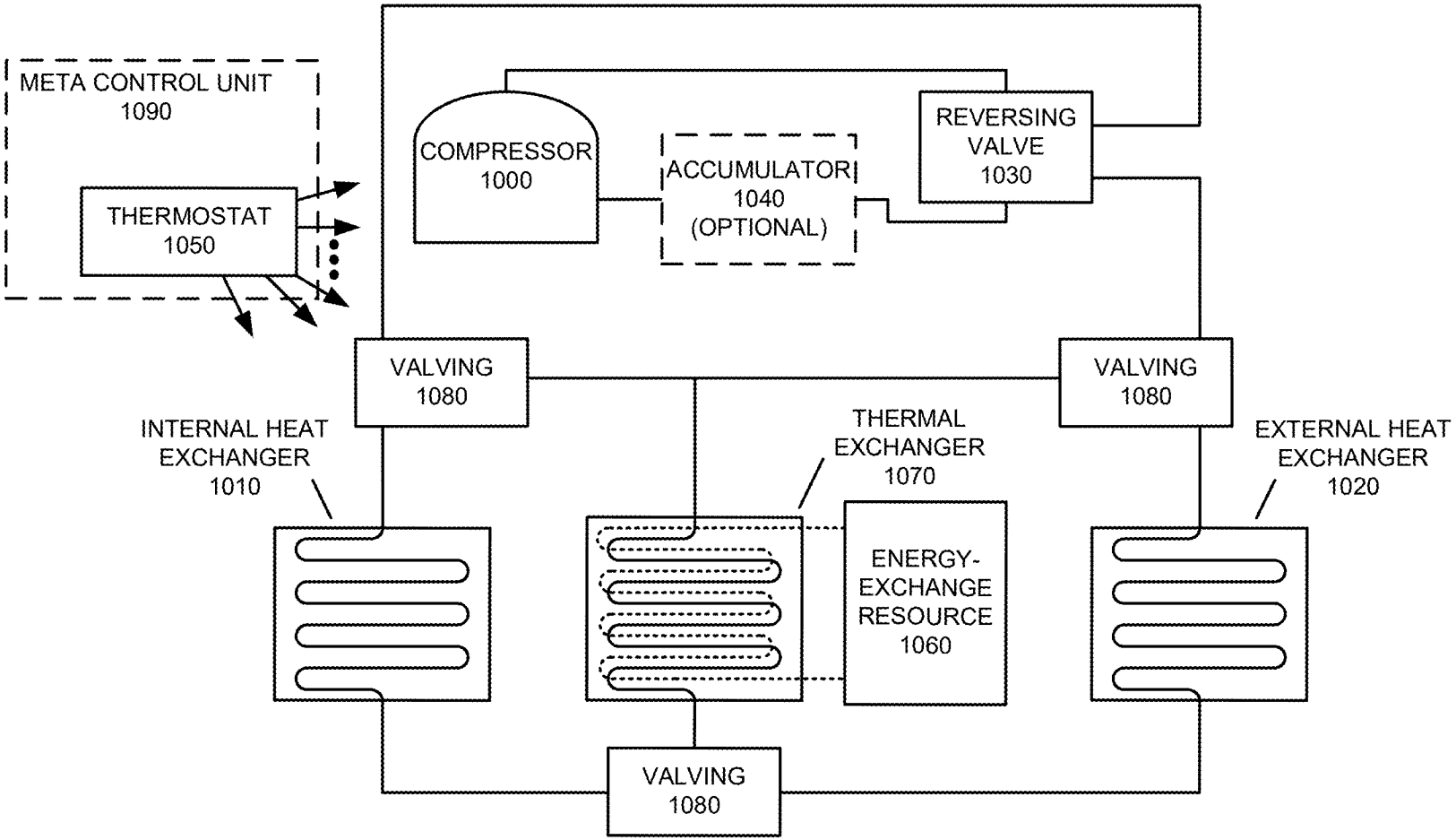
FIG. 10 illustrates an exemplary hybrid space-conditioning system in accordance with an embodiment.

FIG. 10 illustrates an exemplary hybrid space-conditioning system with a heat pump configuration that leverages an energy-exchange resource 1060 (e.g., an energy source and/or an energy sink, which are also referred to interchangeably in this disclosure as "thermal storages"). Typical components of a heat pump system comprise a compressor 1000, internal heat exchanger 1010, external heat exchange 1020, and a reversing valve 1030 that can reverse the heat pump system between heating and cooling a target space. An optional accumulator 1040 is also illustrated. A thermostat 1050 sends control signals to these components to operate the system. In addition to the typical heat pump components, the illustrated hybrid system also includes energy-exchange resource 1060, a thermal exchanger 1070 that facilitates heat exchange between the refrigerant circuit and energy-exchange resource 1060, and additional valving 1080 that enables the flow of refrigerant through the thermal exchanger 1070 both to charge energy-exchange resource 1060 and to allow energy-exchange resource 1060 to be used as a temperature sink. A similar hybrid air-conditioning system might include many of the same components but exclude reversing valve 1030.

Note that the exemplary system of FIG. 10 may be implemented using a range of different configuration options and styles. For instance, in some embodiments the illustrated system may be installed at the same time as a complete system. Alternatively, components 1000-1050 may have been installed initially as a non-hybrid heat pump system, and the additional components 1060-1080 that enable hybrid refrigeration capabilities may have been added on later in a retrofit. In this case, to minimize changes to the previously-installed system, a meta control unit 1090 may be included that provides the additional disclosed benefits by: (1) detecting control signals being output by existing thermostat 1050 to existing components; (2) using additional sensors (not shown) to detect operation of the previously-installed system's components; and (3) sending control signals to components 1060-1080 to override or modify the behavior of the overall system (e.g., overriding thermostat 1050 for time periods during which the energy-exchange resource 1060 is being charged).

In some embodiments, meta control unit 1090 may track and work around the signals of thermostat 1050 without communicating with the existing system. For instance, meta control unit 1090 may use sensors to detect the signals sent by thermostat 1050 to start the compressor 1000, use other sensors to detect the specific operations that are being initiated by thermostat 1050, and then control other components to adjust or extend the overall operation of the hybrid system (e.g., improving energy efficiency by leveraging an additional temperature sink) while still achieving the results being requested by the user via thermostat 1050 (i.e., the thermostat has overriding control/priority in terms of end results for the overall system, but the meta control unit 1090 may determine how those results are achieved). Alternatively, meta control unit 1090 may directly send and receive signals to/from thermostat 1050 via wireless or hard-wired communication channels. In some alternative embodiments, an existing "smart" reprogrammable thermostat may have the capability to be extended and/or reconfigured to encompass additional hybrid control options.

Note also that while FIG. 10 illustrates a single energy-exchange resource 1060, hybrid systems may include multiple storages and circuits which may serve as heat sinks, cold sinks, or both. Furthermore, hybrid systems may include additional circuits and valving to enable additional features, for example to enable simultaneous conditioning of the indoor space and charging of one or more thermal storages.

In some embodiments, self-learning and reasoning control mechanisms may include artificial intelligence (AI) techniques that are applied to the heating and air conditioning industry. For example, such techniques may be used commercially for operation control of multiple refrigeration operating units with microprocessor and thermostatic controls. Some embodiments of the present invention extend this control to learning optimum watt-reduction operation for more sophisticated systems. For instance, self-learning techniques can be applied to leveraging thermal storage units and/or direct thermal access to further improve and optimize a manufactured refrigeration heating and cooling cycle. Exemplary self-learning techniques incorporated into a hybrid system's control system comprise, but are not limited to, one or more of:

- Determining how long to operate compressor- and cooling-cycle components during off-peak hours to pre-chill a thermal storage system to meet anticipated demand during a subsequent peak cooling period (e.g., a following day).
- Determining how long to operate compressor and heating cycle components during off-peak hours to pre-heat a thermal storage system to meet anticipated demand during a subsequent peak heating period (e.g., a following night).
- Considering the power usage of auxiliary pumps (e.g., additional circulating pumps) and actuator control (e.g., of additional valves) when comparing the host-cycle watt consumption with the potential benefits of charging and/or using the accessible thermal energy of a thermal storage system.
- Striving to maintain a heat sink temperature in the summer that is less than the set point temperature indoors in the summer, and vice versa in winter.
- Operating a cooling cycle at a calculated temperature that is cooler than an indoor thermostat set point (e.g., 10-20 degrees cooler) during cooling cycle operation to take advantage of beneficial outdoor conditions (e.g., temporarily cooler ambient outdoor temperatures) in charging a thermal storage system.
- Operating a heating cycle at a calculated temperature that is warmer than an indoor thermostat set point (e.g., 10-20 degrees warmer) during heating cycle operation to take advantage of beneficial conditions (e.g., temporarily warmer ambient outdoor temperatures) in charging a thermal storage system.
- Establishing indoor set points based on user input and/or from wireless signals to and from thermostat.
- Determining when cooling of a thermal storage system (e.g., a storage tank) has plateaued on daily basis based on specifications and/or tracked history for the thermal storage system.
- Determining when heating of a storage tank has plateaued on daily basis.
- Determining whether heating or cooling of a thermal storage is likely to be more advantageous in terms of system performance based on the current state of the thermal storage, current and/or predicted loads, and temperature/condition forecasts.
- Using energy usage history (e.g., watts consumed by the system as well as calculated thermal energy capacity and/or changes in the thermal storage system) based on prior weather data and/or related usage patterns to determine storage run times.
- Learning user patterns and system operation performance, and considering such tracked/learned information for subsequent predictions (e.g., determining and tracking user preferences in optimizing comfort vs energy-use trade-offs).
- Adjusting system behavior based on priorities specified by a user (e.g., receiving user preferences that specify whether operations affecting a thermal storage system may or may not take priority over EV charging or other competing electric loads, if applicable, or receiving user instructions directing aggressiveness of over-charging a thermal storage in an attempt to further reduce energy usage if actual temperatures deviate from predicted temperatures).

In some embodiments, control logic performing the disclosed self-learning techniques for a hybrid space-conditioning system may be configured to perform one or more of the following operations:

- Default to the original operation of a host conditioning system (e.g., not perform any overriding actions and/or not leverage a thermal storage, or default back to the normal operation of a host conditioning system if any faults are encountered that affect hybrid operation).
- Sense heating and cooling operations via temperature sensors on a reversing valve.
- Sense operation of a compressor by measuring the temperature difference across the compressor inlet and outlet.
- Sense heating and cooling by measuring the voltage across a reversing valve.
- Sense operation of a compressor by measuring the voltage to the compressor.
- Sense operation of an indoor thermostat by detecting voltage to an indoor control board.
- Sense temperatures of one or more independent energy sources.
- Sense operation of at least one analog thermostatic valve (TXV).
- Sense operation of at least one electronic thermostatic valve (ETXV).
- Sense operation of a defrost cycle.

Access both sensors subsequently added on externally to a previously-installed refrigeration system as well as sensors embedded by the manufacturer.

Detect the operation of a backup heat coil and/or heat strips (e.g., a backup heat source that can be used for heat pumps when the external temperature is sufficiently low to make the heat output of a heat pump insufficient).

Access hardwired and/or wireless sensors measuring temperature, voltage, etc.

Override normal system operation of the host conditioning system, including both circuitry added on externally as well as circuitry embedded by the manufacturer.

Operate and/or override one or more of a compressor, an outdoor heat exchange fan, an indoor heat exchange fan, an electronic ETXV, an independent energy source pump(s), an independent energy source fan(s), a supply air resistance heat coil, an indoor thermostat, and/or a low-temperature startup capability.

Function with all voltages.

Close one or more normally-open valves.

Open one or more normally-closed valves.

Stagger valve open/close actuations to prevent fluid velocity hammer.

Stagger valve open/close operations to minimize the pressure differential across valves.

Stagger multiple solenoid valve openings and closings.

Cycle valves over a time duration to reduce the condensing of refrigerant gas in idle heat exchangers.

Detect and/or support security levels for configuration information input and/or provided by a manufacturer, installer, and user. For instance, (1) the manufacturer may include security mechanisms that protect the installed software and/or firmware, (2) an installer may add some additional configuration parameters based on the system and structure that the system is installed in, and (3) the user(s) of the system may set a number of parameters based on personal preferences for heating, energy usage, etc. The control logic may be configured to detect and/or adjust system behavior based on such parameters.

Detect and consider the multiple levels of configuration for the system when finding and installing software and/or firmware updates for the system.

Track watt consumption on a periodic and/or ongoing basis.

Track operation usage of operating cycles for the system—e.g., perform both long- and short-term system monitoring to detect changes and/or trends in system components, usage, and operation. Such information can be used to monitor refrigeration cycle performance, detect user habits, predict needed maintenance, detect potential pending failures or issues, and determine potential control improvements that might improve performance and/or comfort.

Provide warning of watt usage where and/or when power penalties are imposed.

Receive input on Time-Of-Use (TOU) utility rates.

Receive input on an EV charging schedule and other known electric loads.

Receive input on system conditions from an independent diagnostic program.

Access historical and predicted weather conditions from one or more independent sources.

Track and maintain a history of weather, sensor readings, and system operation.

Predict the amount of thermal hot or cold energy needed for 24 hour operation.

Operate the refrigeration cycle independently of the thermostat to meet predicted demand over a time period that exceeds a specified time period (e.g., on a 24 hour, weekly, monthly, and/or seasonal timeframe).

Determine the best source of thermal energy for 24 hour operation.

Track and learn the characteristics of a refrigeration cycle and/or sustainable energy source(s).

Receive updates via a range of input mechanisms and software platforms (e.g., via wired and wireless network connections, mobile devices, etc.).

Calculate and track EERs for predictable operation.

Communicate data in at least one direction with one or more optional data tracking platforms, diagnostic platforms, EMS platforms, optional time-varying rate platforms (e.g., time-of-use notification systems, etc.), and utility power-use control platforms.

Communicate with a refrigeration valve assembly.

Communicate with at least one subset water/glycol valve and piping assembly.

Override a variable frequency drive and/or an AC-rectified-to-DC-variable-speed drive.

Send variable-speed signals to one or more compressors and/or pumps;

Leverage knowledge of monthly and shoulder-month patterns to guide daily predictions.

Access remote controls and sensors.

Use wireless communication to operate relays.

Leverage sensors to measure one or more of current, voltage, temperature, and/or pressure.

Adjust system behavior based on predicted and announced events. For instance, notifications from an energy management service (EMS) or utility may indicate rate changes, outages, or other factors that may change operation times for climate control and the charging of thermal storages. Examples that could affect charging include: (1) load shedding and shifting (e.g., known EV charging times, forecasts of rolling blackouts, outages, etc.); (2) event forecasting; and (3) energy harvesting (e.g., not performing thermal storage charging during times when energy is more expensive and/or it is more favorable to sell the output of available local energy-generation sources to utilities at peak prices instead).

In some embodiments, the control logic for a hybrid space-conditioning system is initialized with an initial set of parameters, and then continuously monitors system operation and environmental data to refine operation. For example, initial configuration may include the time, date, and specific location where the system is installed, from which the control system can determine the current season, general climate, rough peak and shoulder season timeframes, and a predicted temperature range. Initial configuration also includes a list of system components, system sensors, and what those sensors are measuring (e.g., temperature, pressure, and/or voltage for a given component or point in the refrigerant circuit, exterior temperature, interior temperature, thermal system temperature, etc.).

During operation, the control logic receives user temperature requests and/or schedules and uses tracked and predicted data to provide heating and cooling to the monitored space. For instance, the control logic may compare the selected temperatures set (and/or previously set) by users with predicted ambient temperature forecasts gathered from forecasts and/or tracked trends. For example, the control logic may determine predicted ambient temperature for the next 24 hours using rate of change calculations, based on trends tracked in the preceding 'x' days, and/or based on downloaded forecasts for the next 'y' days. The control logic may then evaluate the available energy sources that will have an impact over the next 24 hours (e.g., expected ambient air temperature and its effect on an air-source refrigeration circuit, solar energy resources, thermal storage resources, etc.) to evaluate whether thermal charging will be beneficial. In some timeframes, self-learning techniques will predict that the heating and/or cooling needs of the next 24 hours (or other selected timeframe) can be met using the standard air-source circuit, and that consuming additional wattage to leverage a thermal storage will not provide any benefit. More specifically, there will be sufficient heat in the ambient air to run a heating cycle efficiently in the needed timeframe (or vice versa for cooling). Alternatively, the control logic may determine that the level of energy needed over some portion of the next 24 hours will be highly inefficient, calculate and determine that there is a benefit in charging a thermal storage during a timeframe in which the air-source circuit is predicted to operate efficiently, and then leverage the charged thermal storage during the predicted inefficient air-source timeframe to improve overall system efficiency. For example, for a timeframe in which heating is needed, the system may determine that a thermal storage needs to maintain a heat exchange temperature 'z' degrees above a thermostat set point, and then operate the hybrid refrigeration circuit during peak-air-source-heating-efficiency conditions (e.g., during the warmest period of the day) to charge the thermal storage to that set point goal. Similarly, if cooling is needed, the system may determine that a cooling exchange temperature 'z' degrees below the thermostat set point is needed to cool the thermal storage appropriately, and do so at an optimal time (e.g., operating the heat pump in the night or early morning to cool the thermal storage in a timeframe where heat can easily and efficiently be dissipated into the ambient air).

In some embodiments, monitored data is leveraged to improve overall system operation and efficiency. As the system operates to fulfill user requests, the control logic tracks and collects sensor data and compares this data to downloaded data and system characteristics to evaluate prediction accuracy, system health, and energy efficiency. Examples of leveraging monitored data include:

- Comparing tracked ambient temperature data with downloaded NOAA predictions to determine discrepancies and differences for the specific installation, and adjusting subsequent predictions accordingly to improve system efficiency.
- Tracking refrigeration cycle and component performance over time, comparing with known component tolerances, and predicting needed maintenance and/or potential failures. For example, the control logic can ensure that compressor operation remains within manufacturer specifications.
- Tracking user requests to determine user habits, and then incorporating user habit data into subsequent predictions.
- Tracking the wattage consumed by the operating hybrid system over the time period, calculating the wattage that would have been consumed in the default (non-hybrid) mode based on actual ambient temperatures, and determining whether the energy saving calculations that motivated using the thermal storage were accurate to guide future decisions (and vice versa when operating in default mode).
- Predicting heating and cooling needs over a continuous 24-hour period (or some other time interval) and operating hybrid components and the storage system dynamically to control maximum and minimum heat-exchange conditions and maximize COP.

In some embodiments, monitoring data from a number of comparable deployed systems may also be aggregated and/or statistically analyzed to facilitate detecting anomalies, larger trends, and opportunities for improved decision-making.

FIG. 1 illustrates a Venn diagram that shows the relationship between three process features that comprise a hybrid space-conditioning system and the disclosed control techniques. In the Venn diagram, the three process features comprise: (1) an air-source space conditioning system 200 that typically comprise one or more electric motors (e.g., a compressor and fan motor(s)); (2) one or more hybrid energy-exchange resources 300 (which may include a range of energy sources and energy sinks that are sometimes also referred to as "hybrid energy absorbers and dissipators," and can include, but are not limited to, one or more directly-accessed-hybrid-energy sources, indirectly-accessed hybrid-energy sources, and/or direct solar energy absorption systems) and some mechanism of heat exchange; and (3) a refrigerant diverting system 100 that will typically comprise a piping system with one or more valves and solenoids that allows energy transfer between 200 and 300. An exemplary selection of accessible energy sources and/or heat sinks are disclosed and illustrated in FIG. 2. In the Venn diagram, the overlap of the three circles illustrates how each of the three process features are monitored and/or controlled by the self-learning hybrid-system control mechanism 110. More specifically, the three intersecting areas represent: (1) a set of techniques and mechanisms to divert refrigerant from the air-source cycle flow path 120; (2) a set of techniques and mechanisms to operate hybrid energy source components and the flow path 130 to hybrid energy sources 300; and (3) a set of techniques and mechanisms to detect and control hybrid-energy-source availability and state 140; and manage interactions between the air-source space conditioning system 200 and the hybrid energy source(s) 300. The self-learning hybrid system control mechanism 110 controls and provides operating parameters for all of the interactions between the three process features.

Figure 2:
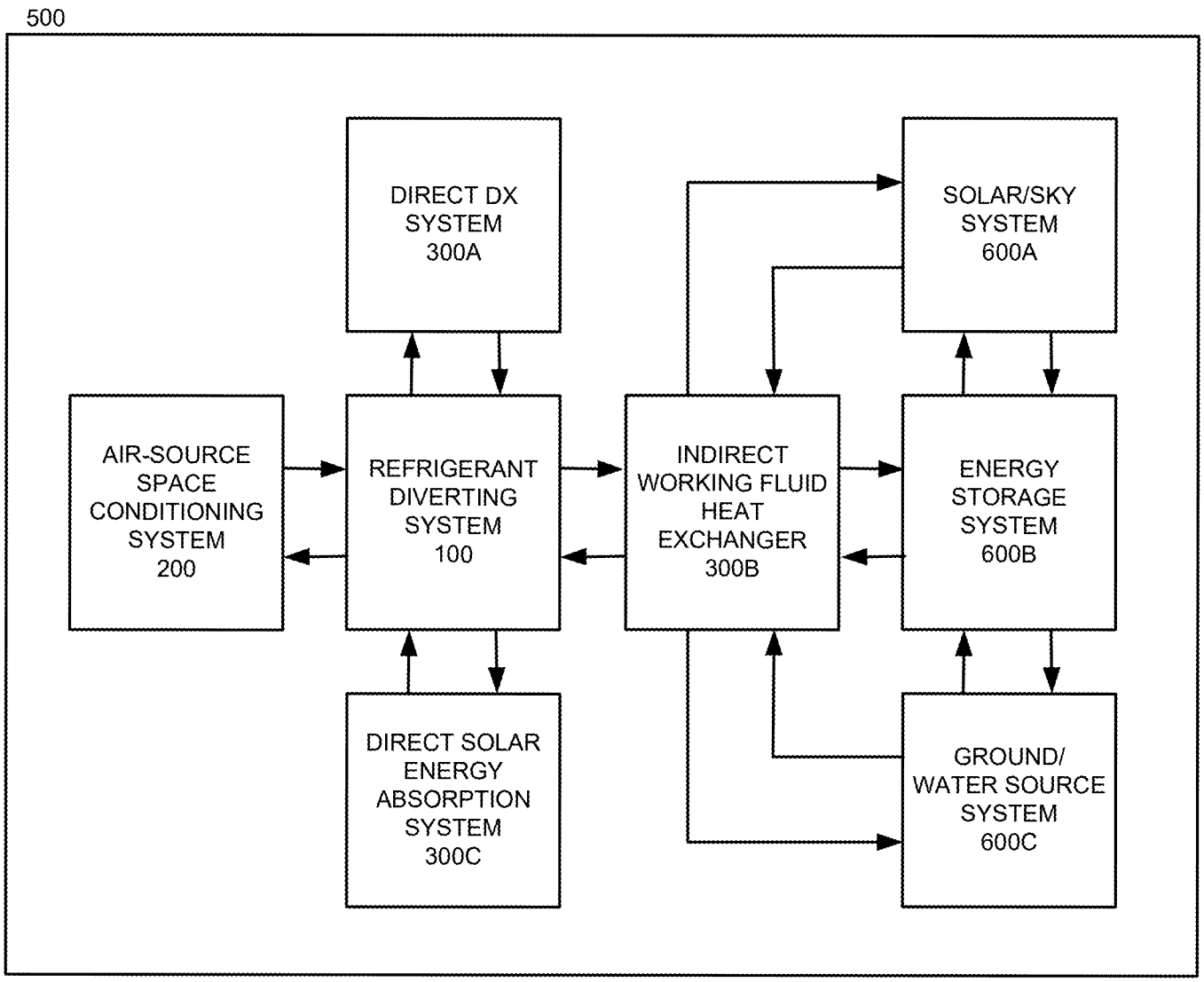
FIG. 2 illustrates an exemplary hybrid refrigeration system in which a set of exemplary hybrid energy sources can be controlled using the disclosed techniques in accordance with an embodiment.

FIG. 2 illustrates an exemplary hybrid space-conditioning system 500 in which a set of exemplary hybrid energy sources can be controlled using the disclosed techniques, with arrows indicating the possible directions of energy flows. Energy can be exchanged either directly or indirectly between air-source space conditioning system 200 and a range of hybrid energy sources via refrigerant diverting system 100 (e.g., piping, valves, etc.). One exemplary hybrid energy source is a direct expansion coil (DX) system 300A in which refrigerant is routed to a heat source or heat sink (e.g., an attic, garage, and/or solar air system). A second set of exemplary hybrid energy sources indirectly exchange heat with a heat source or heat sink via a working-fluid heat exchanger 300B (e.g., exchanging heat via water, water/anti-freeze mix, glycol, etc.). A third exemplary hybrid energy source is a direct solar energy absorption system 300C, for which cycle refrigerant from refrigerant diverting system 100 is directly routed to a thermal solar panel in order to achieve higher enthalpy within the cycle by supplying warmer air. Note that any of 300A-300C may rely on the compressor in air-source space conditioning system for refrigerant flow. Note that a range of motors, pumps, and/or valves may be used to route refrigerant and/or other working fluids between the illustrated components.

FIG. 2 further illustrates a range of exemplary energy source and/or energy sinks 600A, 600B, and 600C, which exchange energy via indirect working fluid exchanger 300B (and may also be configured to exchange energy with each other, as illustrated). All of 600A-C may support bidirectional energy transfers, and rely on the working fluid to transfer energy to and from system 200. For instance, solar sky system 600A may comprise routing the working fluid through a pool-heating system, a glazed-glass solar-hot-water system, and/or a night sky heat dissipation system. An energy storage system 600B may also be configured to provide energy via heat exchanger 300B. Energy storage system 600C may include a single sensible energy phase (hot water, sand, rocks, concrete foundations, etc.) or a two-phase sensible and latent energy medium (water/ice and/or another phase change material). A third exemplary heat source/sink comprises a ground and/or water source system 600C, which can extract or discharge energy to sources such as swimming pools, ponds, water wells, ground loops, etc. In summary, a wide range of hot and cold sources can be coupled to a refrigeration host cycle to improve the COP of an air-source air-conditioning or heat-pump system. In some embodiments, multiple heat pumps serving different areas (e.g., apartments) in a given structure or set of structures may share access to a common set of such thermal energy sources via some control and/or sharing mechanism.

Figure 3:
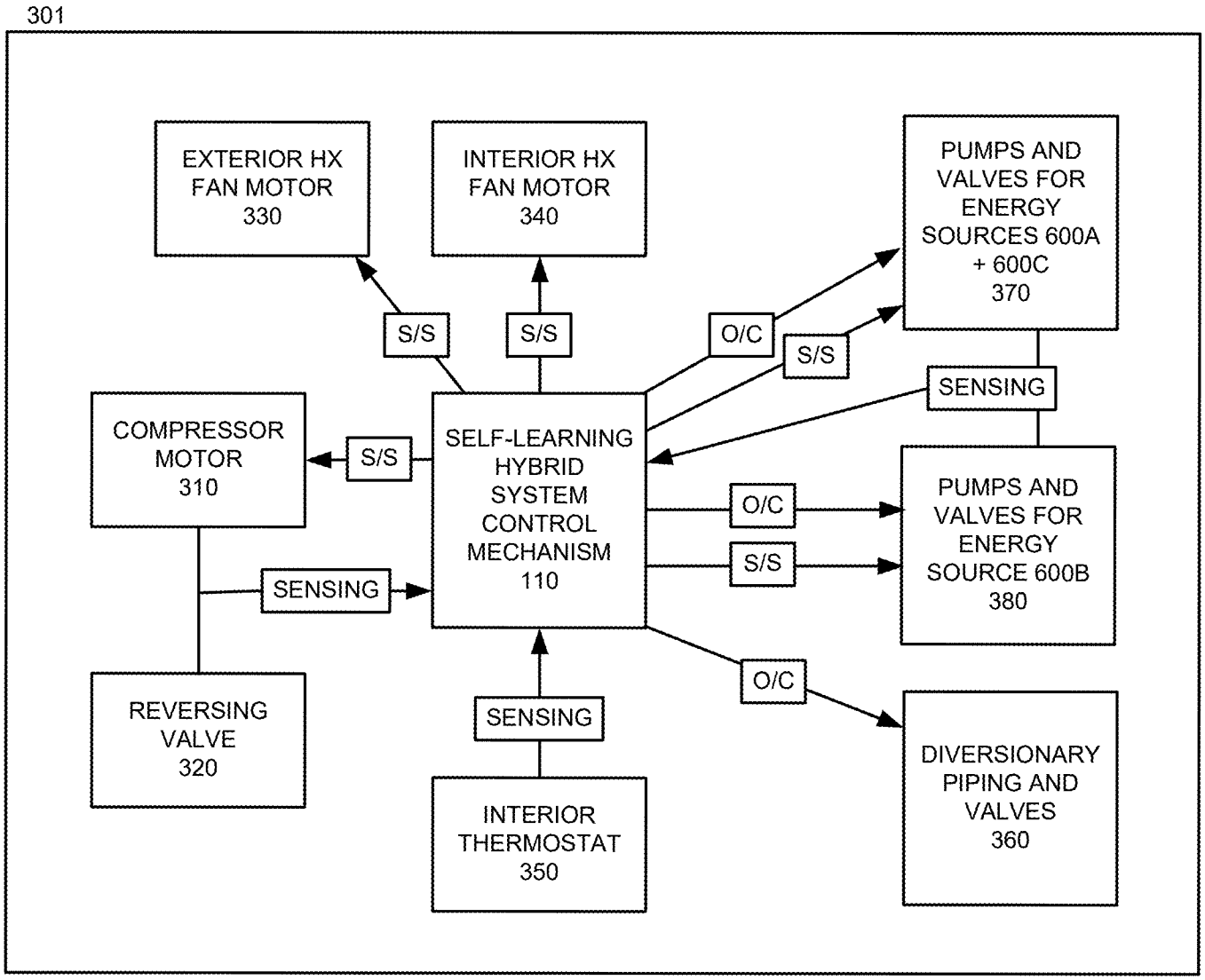
FIG. 3 illustrates an exemplary retrofit hybrid conditioning system with exemplary individual heat-pump components that are controlled by a self-learning hybrid system control mechanism in accordance with an embodiment.

FIG. 3 illustrates an exemplary retrofit hybrid space-conditioning system 301 with exemplary individual heat-pump components that are controlled by a self-learning hybrid system control mechanism 110. Abbreviated blocks include blocks labeled "S/S", which indicate motor start/stop signals, and blocks labeled "O/C", which indicate valve open/close signals. "Sensing" blocks represent any of a wide variety of techniques that can be used to determine the energy condition of a discretionary source of heat or cooling. Standard heat pump components comprise compressor motor 310, reversing valve 320, an exterior fan motor 330 that moves air through an exterior heat exchange system, an interior fan motor 340 that moves air through an interior heat exchange system, and an interior thermostat 350 that controls the operation of the heat pump system. Interior thermostat 350 may be a simple analog binary switch that selects a heating/cooling mode or a more advanced smart device configured with adaptive indoor environmental and user communication applications. In order to extend an existing heat pump system design and create a hybrid conditioning system (as illustrated in FIG. 2), an additional set of diversionary solenoid-actuated valves and piping 360 creates a bridge to energy storage system 600*b* and energy sources 600*a* and 600*c*, each of which may have an associated set of pumps and valves 370-380 that need to be controlled. As illustrated in FIG. 3 control mechanism 110 receives sensing date from and/or has overriding control of all of the components shown; there are a range of known methods of inserting overriding control devices to accomplish such interior and exterior smart control. Additionally, energy sensing techniques can leverage a range of known techniques for determining conditions of components and systems. The disclosed embodiments can leverage any known and heretofore unknown methods and technologies in order to accomplish the highest COP goals. Note that while FIG. 3 illustrates the primary components of a heat pump and an exemplary energy storage system 600*b*, some embodiments may not necessarily include all of the components illustrated FIG. 3, and self-learning hybrid system control mechanism 110 should not be considered limited in its scope of application. For instance, reversing valve 320 or energy storage 600*b* are independent of each other and might not be included in some systems.

As mentioned above, some embodiments leverage self-learning and reasoning techniques to couple an air-source air conditioning or heat-pump refrigeration cycle with a hybrid piping and heat exchange cycle to improve the efficiency of a space conditioning system. There can be several different levels of control under the scope of the present invention based on the user's discretionary requirements. FIG. 2 illustrated several exemplary configurations for an energy storage system.

Figure 4:
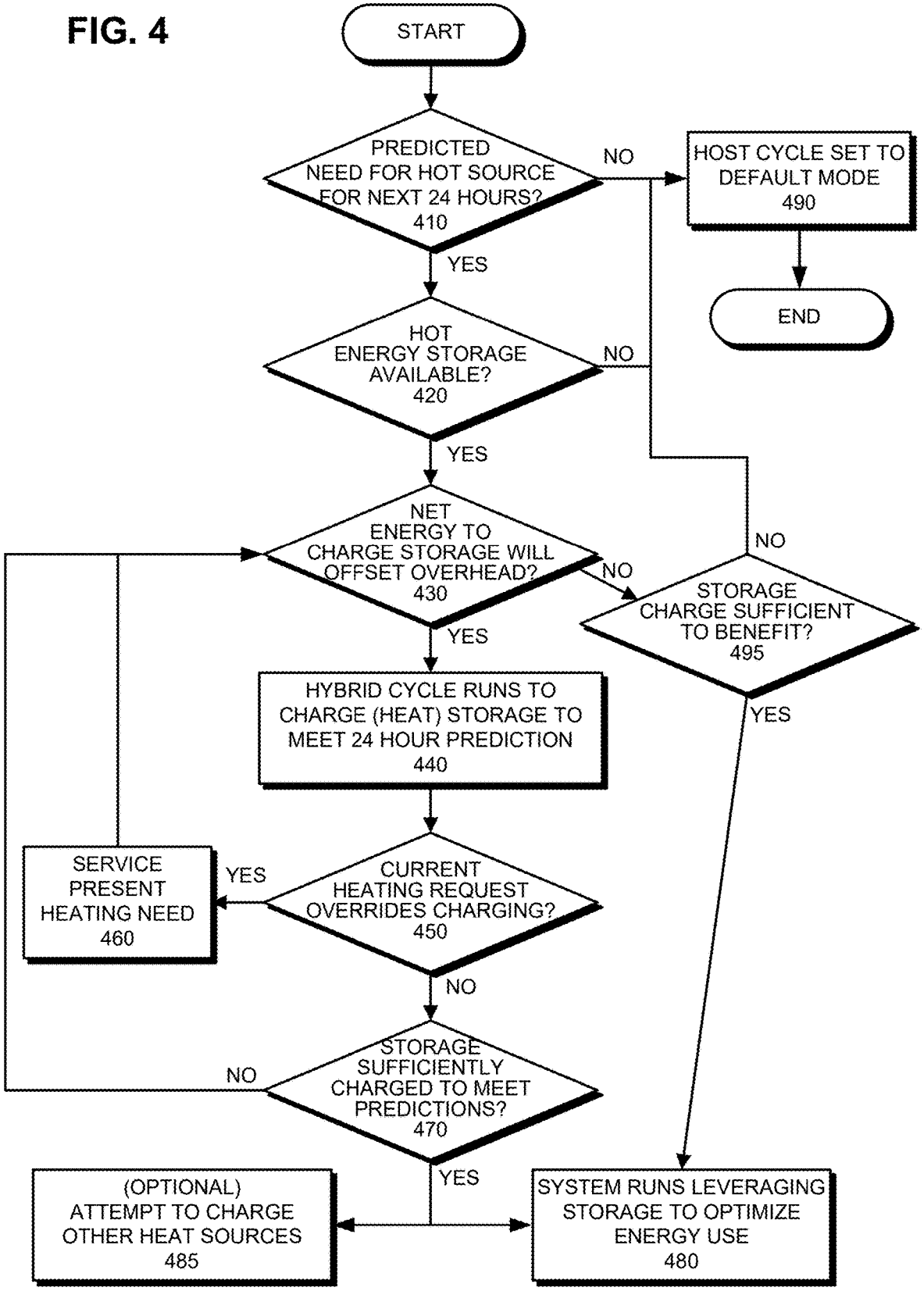
FIG. 4 illustrates an exemplary logic path for a control system that operates a heat pump, hybrid piping and one or more energy-storage systems to beneficially charge and leverage heat availability in accordance with an embodiment.

FIG. 4 illustrates in greater detail an exemplary logic path for a control system that operates a heat pump, hybrid piping and one or more energy-storage systems to beneficially charge and leverage heat availability. In this example, the control system leverages a heat-energy storage system when controlling space conditioning in a climate zone that is shifting daily from a cooling shoulder period into winter mode and back into a warming shoulder period. In the illustrated logic path, the control system predicts the need for a hot source for the next 24 hours (operation 410), and, if so, determines whether a hot energy storage mechanism is available (operation 420). If neither is the case, the host cycle is set to the default mode of the heat pump system (e.g., using the air-source circuit for heating) (operation 490). If the hot energy storage is available, the control system calculates whether the net energy to charge the storage will offset overhead (operation 430)—i.e., whether the overhead of reconfiguring the system's valving, running circulating pumps, storing heat to the hot energy storage and then subsequently accessing the hot energy storage would provide an efficiency improvement over the next 24 hours. If in the course of the time period the energy storage mechanism cannot increase temperatures above ambient air temperatures due to weather or because the watts needed to deliver and maintain heat in the storage mechanism off-set the benefits of accessing the storage (operation 495), the control system keeps the conditioning cycle in default mode (e.g., standard air-source heat-pump operation). If calculated benefits are favorable, the control system runs the hybrid cycle to charge the heat storage to meet the 24 hour predictions (operation 440). Throughout this process the control system monitors the heat storage to determine if the storage is sufficiently charged to meet predictions (operation 470), and also monitors conditions to ensure that the ongoing charging remains net energy positive (looping back to operation 430). Furthermore, if the control system receives (and/or detects) any requests for immediate heat (operation 450) in the conditioned space, it may pause charging to service the present heating needs (operation 460)—alternatively, if supported, the hybrid system may also simultaneously charge the storage at a reduced rate while also servicing current heating needs (not shown). Given favorable conditions, the control system continues charging until the heat storage is sufficiently charged to meet predictions (operation 470). At that point, the control system can run the hybrid conditioning system in hybrid mode as predicted, leveraging the heat storage to optimize energy use (operation 480). Optionally, if charging conditions remain particularly favorable, the control system may be configured to (based on calculations and/or user configuration) charge other available heat sources (e.g., a hot water tank) (operation 485) or, if the heat storage has additional capacity and the ability to retain heat for a sufficiently beneficial timeframe, charge the heat storage some additional amount to account for deviations from the predicted needs (e.g., "overcharge" predictively).

Note that if at any point in the iterative charging loop the conditions for charging become unfavorable (e.g., outside temperatures drop after some point of the day), the control system may halt charging (the 'no' path from operation 430). If the storage is sufficiently charged to provide benefits (operation 495), the storage can subsequently be leveraged in hybrid mode (operation 480), otherwise the system can be operated in default air-source mode (operation 490). Note also that such decisions may be revisited many times in a given time period, and that the illustrated path may be traversed multiple times—for instance, while beneficial heat-source charging is most likely to be obtained during daytime hours, temperature conditions may fluctuate in more than one cycle during the day (e.g., based on cloud cover, storms, etc.), and hence conditions becoming unfavorable at one given point in the day do not necessarily indicate that charging may not be resumed and/or begun at some subsequent time if needed.

Figure 5:
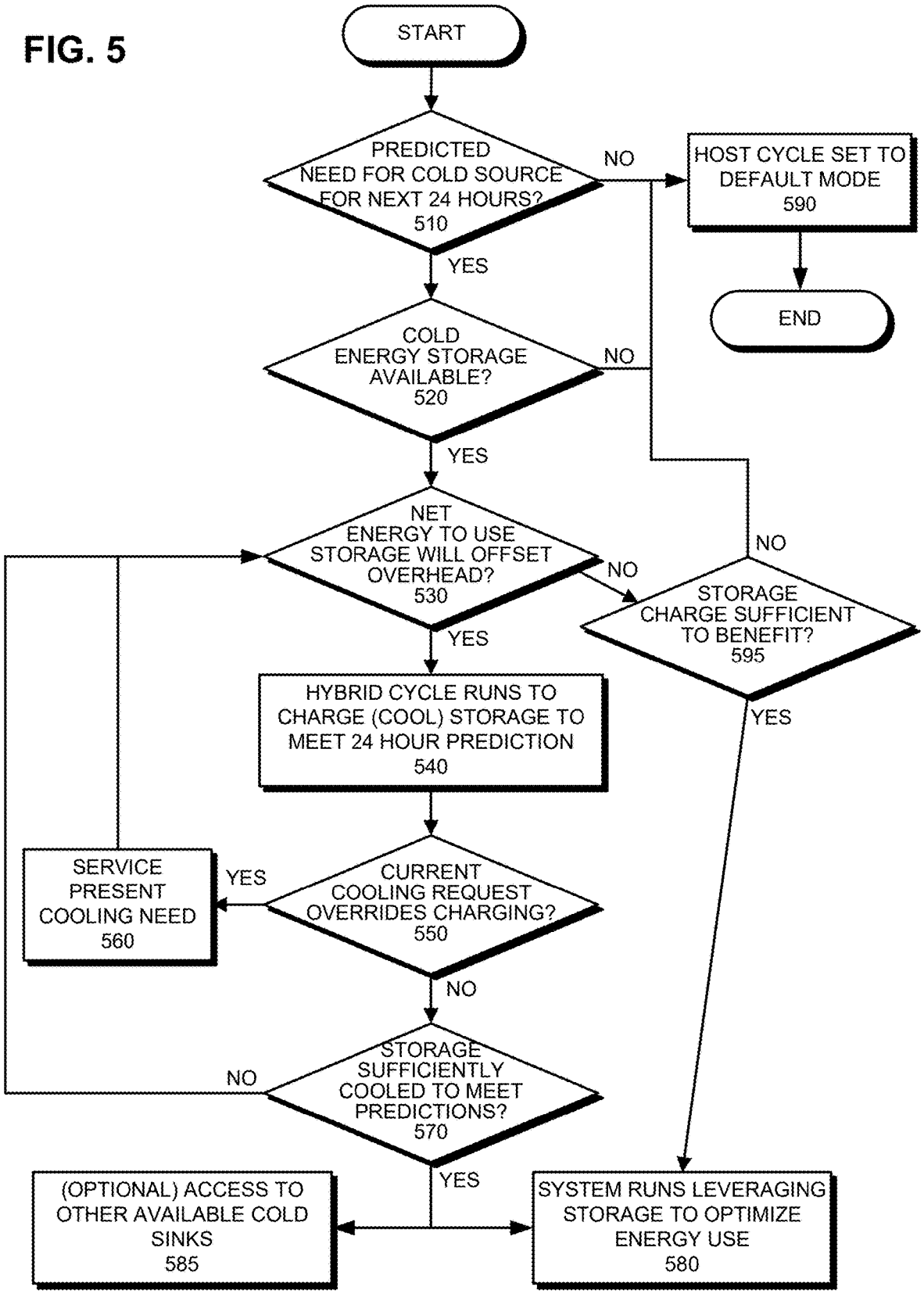
FIG. 5 illustrates an exemplary logic path for a control system that operates a heat pump, hybrid piping and one or more energy-storage systems to beneficially charge and leverage cold availability in accordance with an embodiment.

FIG. 5 illustrates an exemplary logic path for a control system that operates a heat pump, hybrid piping and one or more energy-storage systems to beneficially charge and leverage cold availability, in contrast to FIG. 4's leveraging of heat availability. In FIG. 5, the control system leverages a cold-energy storage system when controlling space conditioning in a climate zone that is shifting daily from a warming shoulder period into summer mode and back into a cooling shoulder period. In the illustrated logic path, the control system predicts the need for a cold source for the next 24 hours (operation 510), and, if so, determines whether a cold energy storage mechanism is available (operation 520). If neither is the case, the host cycle is set to the default mode of the heat pump system (e.g., using the air-source circuit for cooling) (operation 590). If the cold energy storage is available, the control system calculates whether the net energy to charge the storage will offset overhead (operation 530)—i.e., whether the overhead of cooling the cold energy storage and then subsequently accessing the cold energy storage would provide an efficiency improvement over the next 24 hours. If in the course of the time period the energy storage mechanism cannot decrease temperatures below ambient air temperatures due to weather or because the watts needed to deliver and maintain cold in the storage mechanism off-set the benefits of accessing the storage (operation 595), the control system keeps the conditioning cycle in default mode (e.g., standard air-source heat-pump operation). If calculated benefits are favorable, the control system runs the hybrid cycle to charge the cold storage to meet the 24 hour predictions (operation 540). Throughout this process the control system monitors the heat storage to determine if the storage is sufficiently charged to meet predictions (operation 470), and also monitors conditions to ensure that the ongoing charging remains net energy positive (looping back to operation 530). Furthermore, if the control system receives (and/or detects) any requests for immediate cooling (operation 550) in the conditioned space, it may pause charging to service the present cooling needs (operation 560)—alternatively, if supported, the hybrid system may also simultaneously charge the storage at a reduced rate while also servicing current cooling needs (not shown). Given favorable conditions, the control system continues charging until the cold storage is sufficiently charged to meet predictions (operation 570). At that point, the control system can run the hybrid conditioning system in hybrid mode as predicted, leveraging the cold storage to optimize energy use (operation 580). Optionally, if charging conditions remain particularly favorable, the control system may be configured to (based on calculations and/or user configuration) charge other available cold sources (e.g., a swimming pool) (operation 585) or, if the cold storage has additional capacity and the ability to retain cold for a sufficiently beneficial timeframe, cool the cold storage some additional amount to account for deviations from the predicted needs.

As in FIG. 4, in FIG. 5 if at any point in the iterative charging loop the conditions for charging become unfavorable, the control system may halt charging (the 'no' path from operation 530). If the storage is sufficiently charged to provide benefits (operation 595), the storage can subsequently be leveraged in hybrid mode (operation 580), otherwise the system can be operated in default air-source mode (operation 590). As in FIG. 4, such decisions may be revisited many times in a given time period, and that the illustrated path may be traversed multiple times. A primary difference between FIG. 4 (heat charging) and FIG. 5 (cold charging) is the optimum time during a 24-hour period to achieved targeted temperature storage—from shoulder to winter and winter to shoulder heat-charging charging operation is more likely to leverage daytime heat for storage, and watt balance would be a controlling factor. For the shoulder to summer to shoulder timeframe, heat rejection is the controlling factor, and cold charging is more likely to occur during cooler night-time and early-morning hours.

Note that while the exemplary descriptions for FIGS. 4 and 5 describe a 24-hour timeframe, the disclosed techniques can be managed over any reasonable time period. For instance, the control system may consider and optimize operation for a time period longer than 24 hours based on the capabilities and/or characteristics of available thermal storage mechanisms, temperature forecasts, and user specifications. For example, the control system may consider manufacturer-specified and/or tracked heat/cold-decay characteristics and capacity for a thermal storage to determine whether overcharging during a given timeframe will provide benefits for a subsequent timeframe (e.g., determining whether pre-charging for several warmer days before an incoming storm will provide sufficient benefits despite storage heat loss over the longer timeframe, or vice versa for cold storage). The control system performs ongoing calculations to dynamically determine the viability and benefits of such decisions.

In some embodiments, the control system for a hybrid climate-control system may consider a range of factors for specific seasonal periods (e.g., shoulder periods) and climate zones where the system is located. For instance, the control system may need to determine how to beneficially operate in climate zones with extreme daily temperature swings, and when (and/or how often) in a shoulder season to transition a thermal storage that can transition between both heat and cold storage. In some configurations (e.g., in a desert or arctic climate), the hybrid climate-control may include both hot and cold storage systems, and may charge and then leverage both on a daily basis. Alternatively, if a single dual-capability storage is available, the control system may calculate and consider the energy overhead and advantages of switching from one mode to the other, along with the season, weather, and temperature forecast, in its decisions. During a transition, the system may use up charged state in the storage as part of a switch to the other mode, and operate temporarily at an unfavorable energy overhead level when switching the state of the energy storage over to the other mode. In some embodiments, the control system also determines from storage specifications whether minimizing such mode cycles is beneficial to the longevity/deterioration of the thermal storage, and factor such information into decisions.

In some embodiments, the control system for a hybrid climate-control system may also determine that there is no net gain in present conditions of charging or accessing an energy-exchange resource, and choose to leave the hybrid system idle. For instance, the control system may determine that a weather period is predicted with optimum conditions, and hence not perform any predictive behavior. Similarly, upon receiving notice or determining that occupants will not be present (e.g., on vacation), the system may remain idle for some time period and then perform the highest-possible efficiency slow-charging in a timeframe just prior to the occupants predicted and/or specified return to have a charged energy-exchange resource available for space-conditioning at that time.

Figure 6:
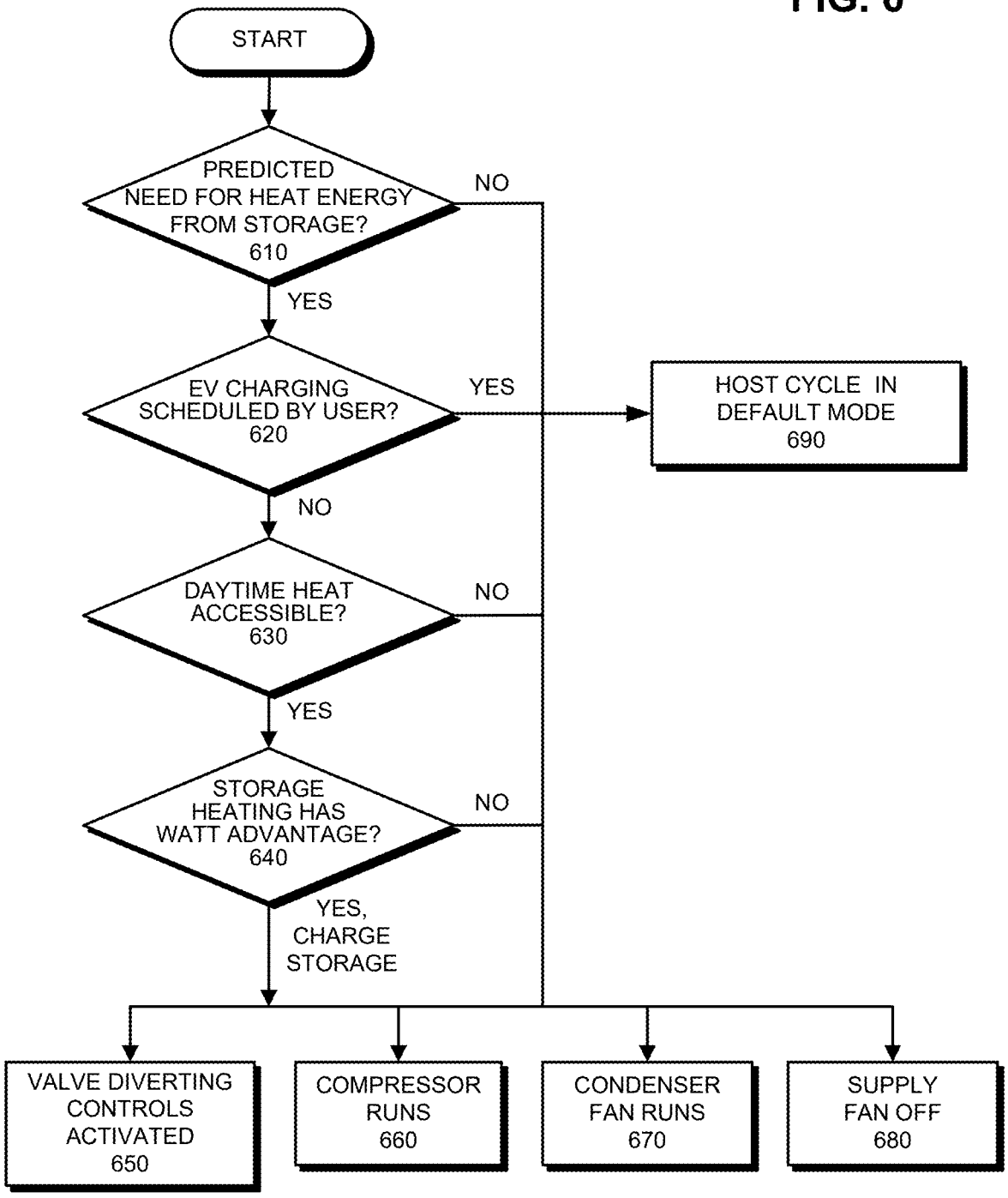
FIG. 6 illustrates a set of exemplary operations performed by a control system of a hybrid space-conditioning system when considering heat-charging decisions in accordance with an embodiment.

FIG. 6 illustrates a set of exemplary operations performed by a control system of a hybrid space-conditioning system when considering heat-charging decisions. During operation, the control system determines if there is a predicted need for heat energy from the heat storage (operation 610). Further, the control system checks whether there is EV charging scheduled by a user in the same timeframe (operation 620), sufficient daytime heat is accessible (operation 630), and if heating the storage currently has a watt advantage (operation 640) (e.g., if charging would be of net advantage). If heat is not needed, available, and/or advantageous, or if EV charging (or some other substantial load) is scheduled in the same timeframe, the system remains in default air-source mode and no charging occurs (operation 690). Otherwise, the storage can be charged, and the control system initiates charging by: (1) activating the valve diverting controls (operation 650); (2) running the compressor (operation 660); (3) running the condenser fan (operation 670); and (4) ensuring that the supply fan is off (operation 680). Note that in an add-on system (where the thermal storage and diversionary piping are retrofit to an existing conventional heat-pump system), actions 650-680 may be initiated independently of a thermostat that controls the conventional heat-pump system to store heat energy during warmer (e.g., daylight) hours for immediate use or storage.

Figure 7:
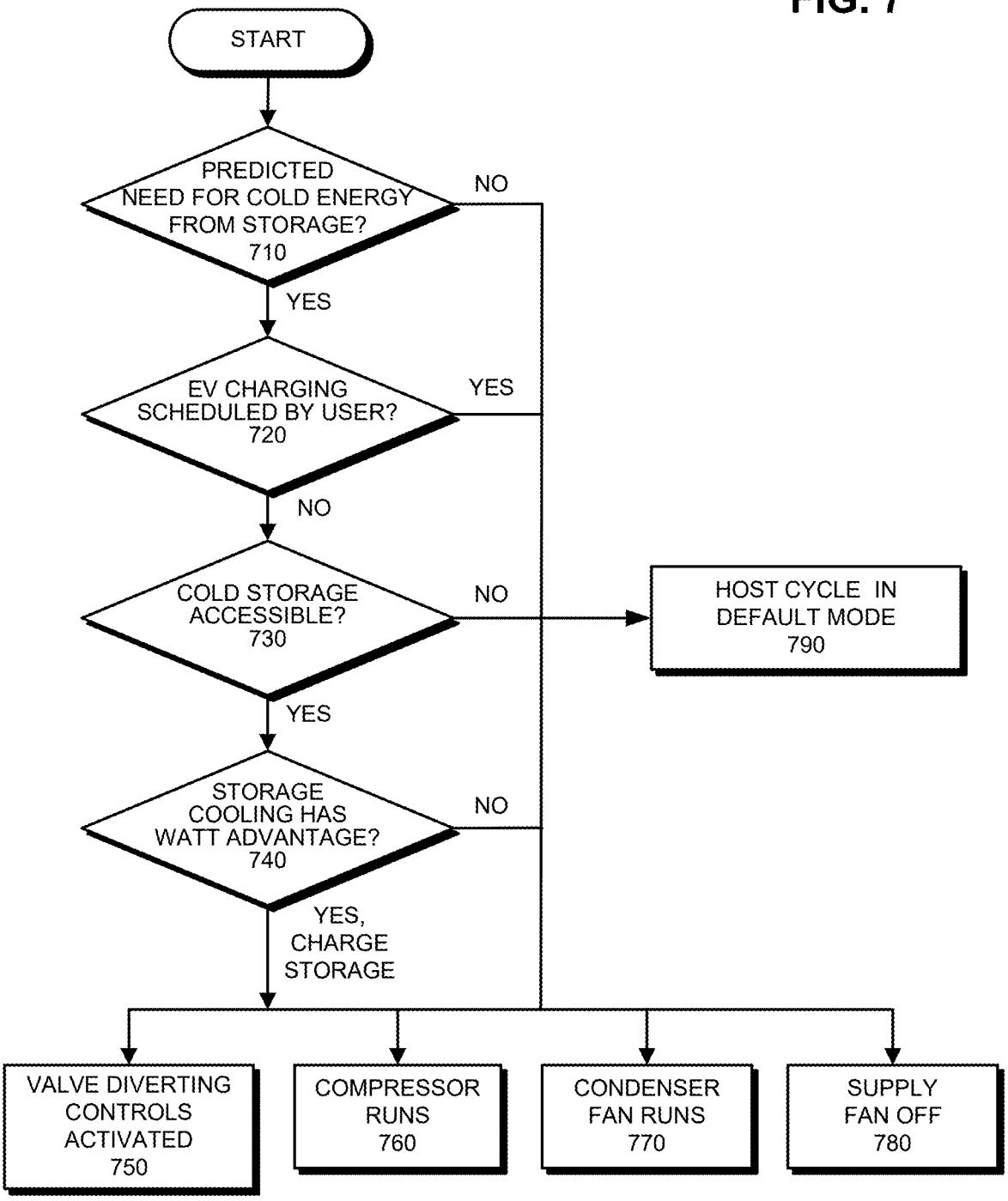
FIG. 7 illustrates a set of exemplary operations performed by a control system of a hybrid space-conditioning system when considering cold-charging decisions in accordance with an embodiment.

FIG. 7 illustrates a set of exemplary operations performed by a control system of a hybrid space-conditioning system when considering cold-charging decisions. During operation, the control system determines if there is a predicted need for cold energy from the heat storage (operation 710). Further, the control system checks whether there is EV charging scheduled by a user in the same timeframe (operation 720), that the cold storage is accessible (operation 730), and if cooling the storage currently has a watt advantage (operation 740) (e.g., if charging would be of net advantage). If cold is not needed and/or advantageous or the cold storage is not accessible, or if EV charging (or some other substantial load) is scheduled in the same timeframe, the system remains in default air-source mode and no charging occurs (operation 790). Otherwise, the storage can be charged, and the control system initiates charging by: (1) activating the valve diverting controls (operation 750); (2) running the compressor (operation 760); (3) running the condenser fan (operation 770); and (4) ensuring that the supply fan is off (operation 780). Note that in an add-on system (where the thermal storage and diversionary piping are retrofit to an existing conventional heat-pump system), actions 750-780 may be initiated independently of a thermostat that controls the conventional heat-pump system to store cold energy during cooler (e.g., nighttime and early morning) hours for immediate use or storage. More specifically, as illustrated in FIGS. 6-7, the control logic of the control system determines charging operation based on the specific system, season, and daytime/nighttime conditions.

In some embodiments, the design of a hybrid space-conditioning system comprises ensuring that the mass flow rates of the two sub-subsystems (e.g., the thermal storage subsystem and the air-source subsystem) match. This is the case both for hybrid systems that are designed and manufactured as one system as well as for hybrid systems that are added to an existing installed host cycle via a retrofit. For instance, the valving and pipe sizing need to match the mass flow rates of the host air-source cycle. Every installation is unique—e.g., every structure may be unique in terms of occupancy, occupant preferences, climate zone, insulation, vacancy patterns, orientation/shading, etc. Furthermore, even systems provided from the same source may comprise sub-components from different manufacturers and/or different models, and hence it is important that the control system be able to adapt to (and ensure the safe operation of) a range of different performance profiles and behaviors. In some embodiments, the control system is able to receive and/or look-up the characteristics and performance curves/data (i.e., "libraries") for all of the components of the hybrid system that is controlling, and leverage this information for control and diagnostic purposes. The control system is then able to use this data to facilitate interactions between system sub-components and ensure that the hybrid system operates both efficiently and without damage.

Figure 8:
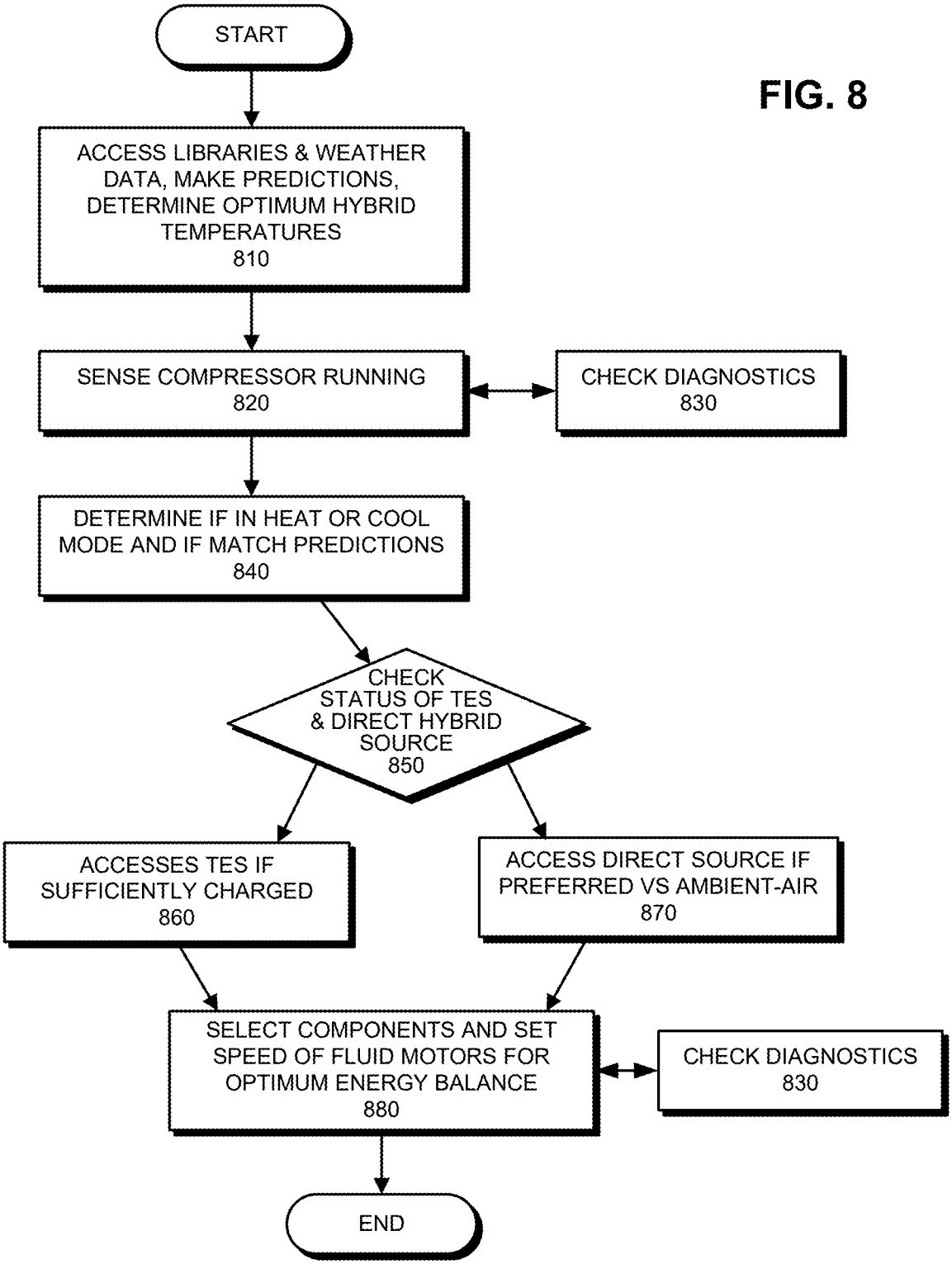
FIG. 8 illustrates an exemplary logic path of an add-on control system that operates to control a hybrid space-conditioning system that has been retrofitted onto an existing host heat pump system in accordance with an embodiment.

FIG. 8 illustrates an exemplary logic path of an add-on control system that operates to control a hybrid space-conditioning system that has been retrofitted onto an existing host heat pump system. During operation, the control system can access libraries (e.g., device characteristic and configuration libraries) and weather data, make predictions, and determine optimum hybrid temperatures (operation 810). The control system determines whether the compressor is running operation 820), and checks diagnostic sensors and data (operation 830) to ensure that there are no issues. The control system determines from sensors whether the host system is in heating or cooling mode and if current ambient conditions match the predictions (operation 840), and checks the status of a thermal energy source (TES) and the conditions of any available direct sources (e.g., a passive nighttime heat dissipation source separate from the host cycle ambient-air system, or a cold sink such as a swimming pool) (operation 850) to determine the most efficient use of available energy sources. For instance, in winter the control system can check the status of a TES in the hybrid system to determine whether the TES is sufficiently charged and then access the TES if sufficiently charged (operation 860). For example, the control system may determine whether the stored energy is sufficient for both day and nighttime access, or if there is only sufficient stored energy to eliminate a defrost cycle and/or avoid the use of auxiliary heat strips. Alternatively, if the TES is not sufficiently charged, the control system may be able to access a direct source that is still more efficient than the ambient-air cycle (operation 870). If neither option is more efficient than the normal ambient-air cycle, the system can default to the host cycle (not shown). Note that during winter, nighttime storage access would typically have a higher priority than daytime. Conversely, during the summer a chilled storage source would have the highest access priority during peak heat periods, when it would provide the most energy savings. For either path (860-870), the control system selects components and sets the speed of fluid motors for optimum energy balance (operation 880), ensuring that available energy is proportioned by flow control based on projected optimum beneficially time periods. Because thermodynamic balance is needed between energy sources and heat exchangers, the control system is configured to continually perform self-diagnostics to verify that the compressor and other components are operating within manufacturer specifications-diagnostics (operation 830) may also be initiated via operation 880 (as shown) or anywhere else in the logic path (not shown).

Figure 9:
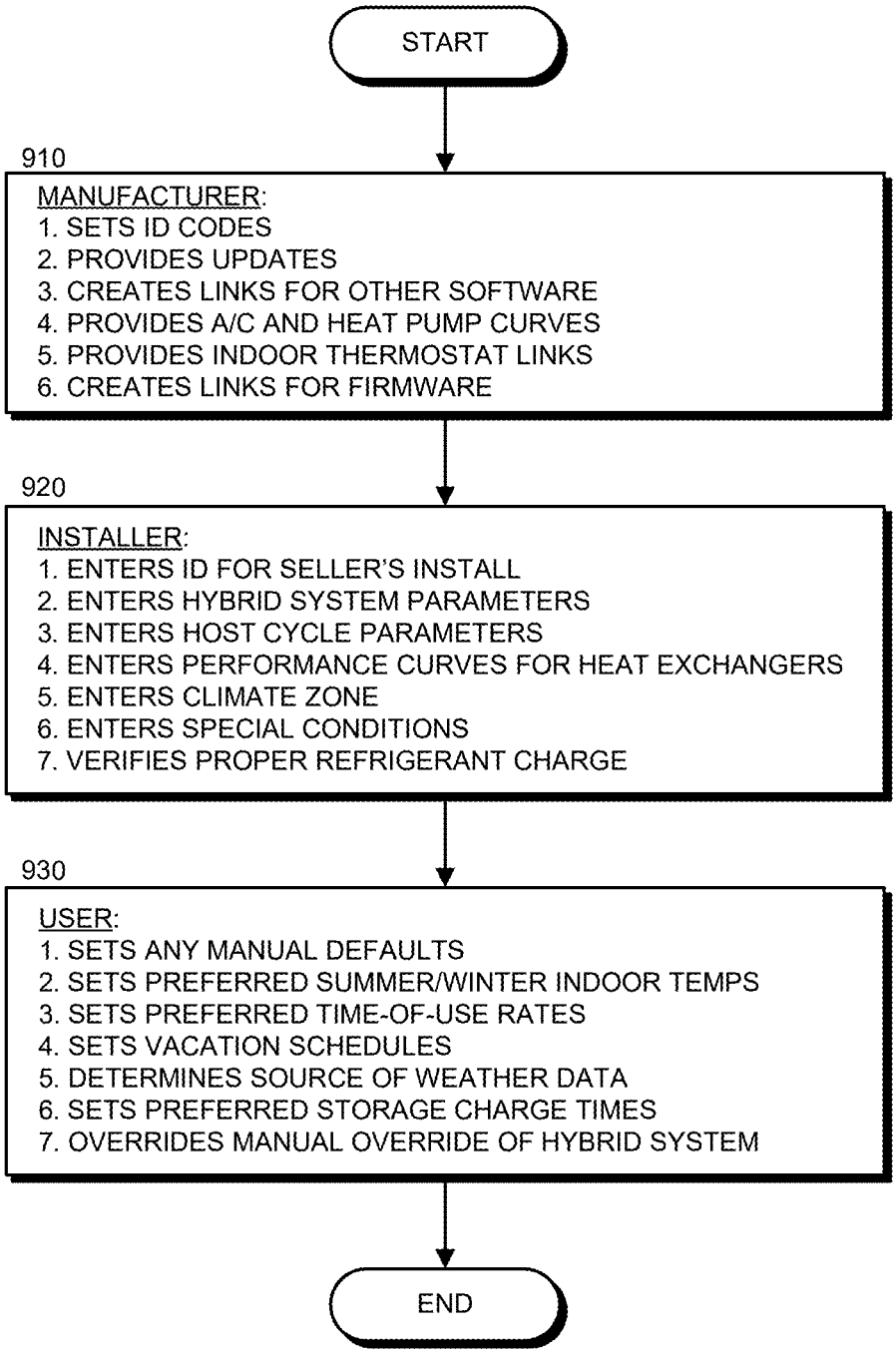
FIG. 9 illustrates exemplary phases of human configuration and input into the control system of a hybrid space-conditioning system in accordance with an embodiment.

FIG. 9 illustrates exemplary phases of human configuration and input into the control system of a hybrid space-conditioning system. In the first phase (operation 910), a manufacturer: (1) sets ID codes; (2) provides updates (and/or configures the system to receive subsequent updates); (3) creates links/interfaces to communicate with external sources (e.g., network-based, 3rd-party diagnostic mechanisms, databases, etc.); (4) provides air conditioning and/or heat pump performance curve information; (5) provides indoor thermostat links (e.g., to enable communication with thermostat vendors and/or additional network-based features such as AI analysis and control capabilities); and (6) creates links for firmware (e.g., to access controls and sensors). Subsequently, an installer installing the manufactured hybrid system (operation 920): (1) enters a unique ID for the install; (2) enters hybrid system parameters; (3) enters host cycle parameters; (4) enters performance curve information for the heat exchangers; (5) enters the climate zone for the location of installation; (6) enters any special condition information relating to the location and/or installation; and (7) verifies that the system has the proper refrigerant charge. After installation, an end-user can configure the control system to meet their specific needs (operation 930), which can comprise: (1) setting any manual defaults; (2) setting preferred summer/winter indoor temperatures; (3) setting the user's utility time-of-use rates and/or other scheduling factors; (4) setting vacation schedules; (5) determining desired sources of weather/forecast data; (6) setting preferred storage charge times; and (7) performing manual overrides of the hybrid system as needed/desired. While FIG. 9 illustrates an exemplary set of configuration actions and/or parameters, a wide range of additional and/or different configuration operations may be used to ensure and/or improve the accuracy and efficiency choices of the control system and smooth operation of the hybrid climate-control system. Note that during operation the control system may leverage additional remote computation, storage services, and/or information sources to improve predictions and system efficiency.

Figure 11:
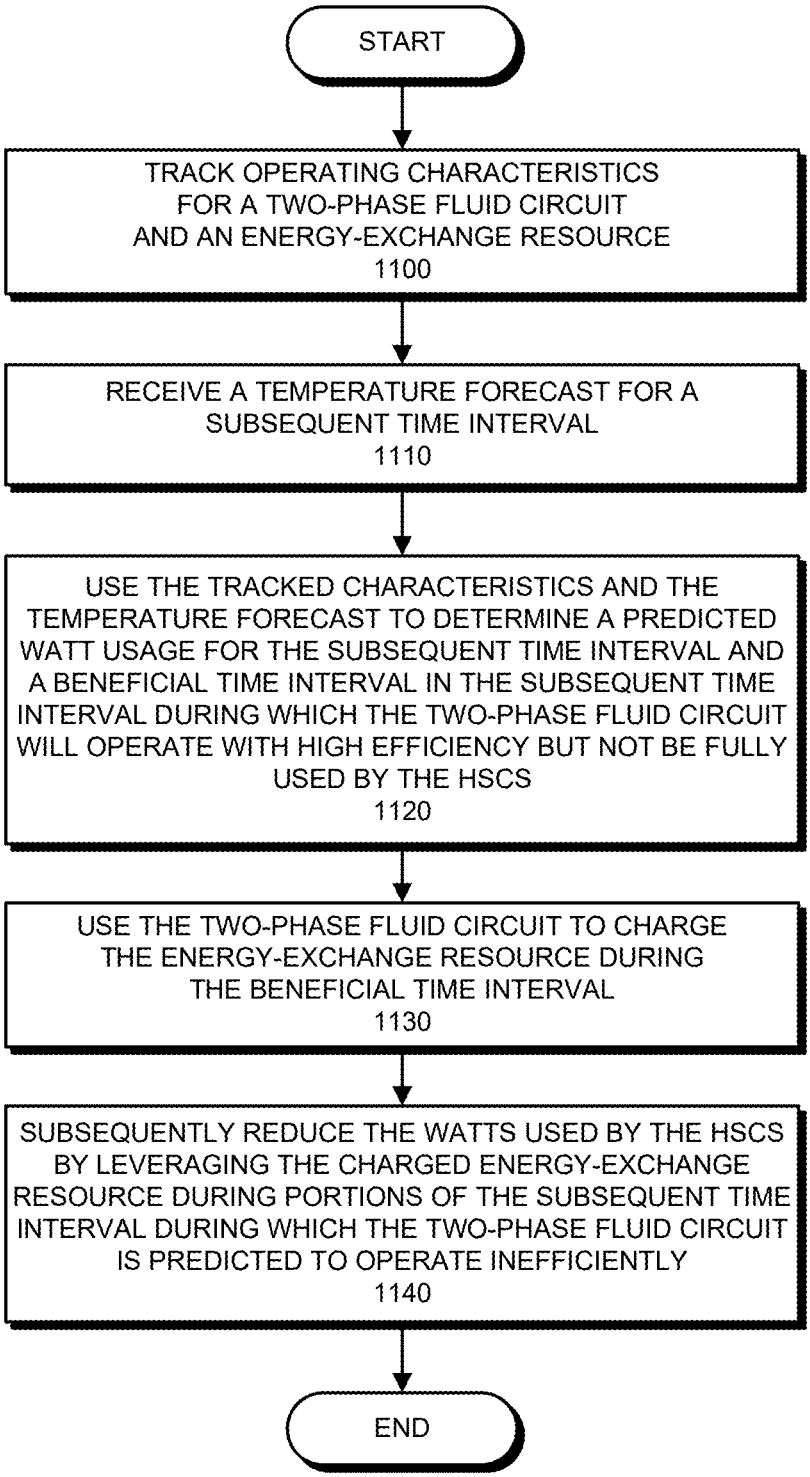
FIG. 11 presents a flow chart that illustrates the process of controlling a hybrid space-conditioning system in accordance with an embodiment.

FIG. 11 presents a flow chart that illustrates the process of controlling a hybrid space-conditioning system (HSCS) that comprises a two-phase fluid circuit and an energy-exchange resource connected in parallel to the two-phase fluid circuit. During operation, a computing mechanism tracks operating characteristics for the two-phase fluid circuit and the energy-exchange resource (operation 1100). The computing mechanism receives a temperature forecast for a subsequent time interval (operation 1110), and uses the tracked characteristics and the temperature forecast to determine a predicted watt usage for the subsequent time interval and a beneficial time interval in the subsequent time interval during which the two-phase fluid circuit will operate with high efficiency but not be fully utilized by the HSCS (operation 1120). The computing mechanism configures the two-phase fluid circuit to charge the energy-exchange resource during the beneficial time interval (operation 1130), and then subsequently reduces the watts used by the HSCS by leveraging the charged energy-exchange resource during portions of the subsequent time interval during which the two-phase fluid circuit is predicted to operate inefficiently (operation 1140).

Computing Environment

Figure 12:
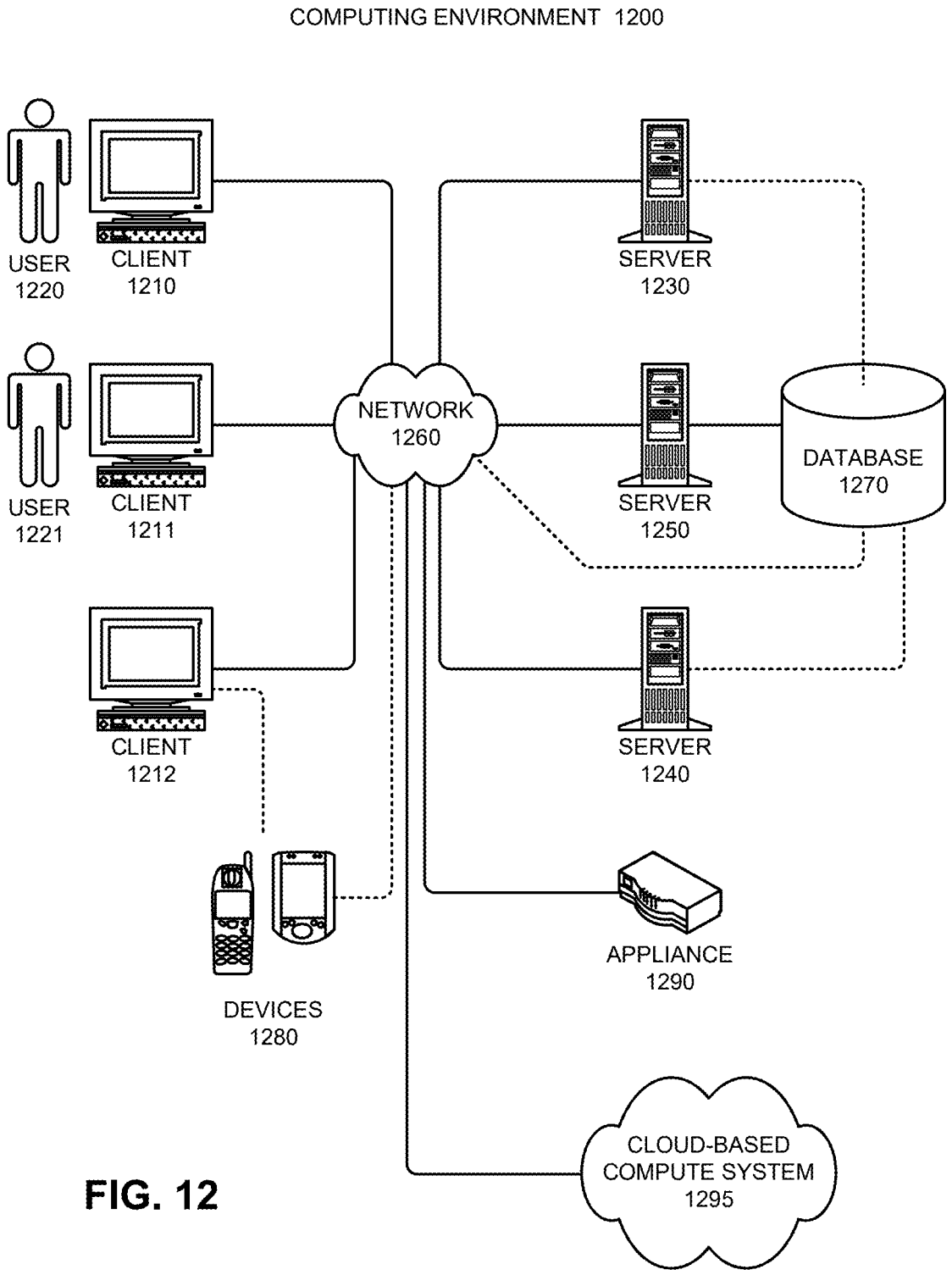
FIG. 12 illustrates a computing environment in accordance with an embodiment.

In summary, embodiments of the present invention facilitate controlling a hybrid space-conditioning system. In some embodiments of the present invention, techniques for tracking operating characteristics, analyzing tracked characteristics and other inputs (e.g., forecast data), and controlling a coolant circuit and/or thermal source can be incorporated into and/or leverage data maintained in a wide range of computing devices in a computing environment. For example, FIG. 12 illustrates a computing environment 1200 in accordance with an embodiment of the present invention. Computing environment 1200 includes a number of computer systems, which can generally include any type of computer system based on a microprocessor, a mainframe computer, a digital signal processor, a portable computing device, a personal organizer, a device controller, or a computational engine within an appliance. More specifically, referring to FIG. 12, computing environment 1200 includes clients 1210-1212, users 1220 and 1221, servers 1230-1250, network 1260, database 1270, devices 1280, appliance 1290, and cloud-based storage system 1295.

Clients 1210-1212 can include any node on a network that includes computational capability and includes a mechanism for communicating across the network and with the HSCS. Additionally, clients 1210-1212 may comprise a tier in an n-tier application architecture, wherein clients 1210-1212 perform as servers (servicing requests from lower tiers or users), and wherein clients 1210-1212 perform as clients (forwarding the requests to a higher tier).

Similarly, servers 1230-1250 can generally include any node on a network including a mechanism for servicing requests from a client for computational and/or data storage resources. Servers 1230-1250 can participate in an advanced computing cluster, or can act as stand-alone servers. For instance, computing environment 1200 can include a large number of compute nodes that are organized into a computing cluster and/or server farm. In one embodiment of the present invention, server 1240 is an online "hot spare" of server 1250. Servers may execute a large number of micro-services and/or virtual machines.

Users 1220 and 1221 can include: an individual; a group of individuals; an organization; a group of organizations; a computing system; a group of computing systems; or any other entity that can interact with computing environment 1200.

Network 1260 can include any type of wired or wireless communication channel capable of coupling together computing nodes. This includes, but is not limited to, a local area network, a wide area network, or a combination of networks. In one embodiment of the present invention, network 1260 includes the Internet. In some embodiments of the present invention, network 1260 includes phone and cellular phone networks.

Database 1270 can include any type of system for storing data in non-volatile storage. This includes, but is not limited to, systems based upon magnetic, optical, or magneto-optical storage devices, as well as storage devices based on flash memory and/or battery-backed up memory. Note that database 1270 can be coupled: to a server (such as server 1250), to a client, or directly to a network. Alternatively, other entities in computing environment 1200 (e.g., servers 1230-1250) may also store such data.

Devices 1280 can include any type of electronic device that can be coupled to a client, such as client 1212. This includes, but is not limited to, cell phones, personal digital assistants (PDAs), smartphones, personal music players (such as MP3 players), gaming systems, digital cameras, portable storage media, or any other device that can be coupled to the client. Note that, in some embodiments of the present invention, devices 1280 can be coupled directly to network 1260 and can function in the same manner as clients 1210-1212.

Appliance 1290 can include any type of appliance that can be coupled to network 1260. This includes, but is not limited to, routers, switches, load balancers, network accelerators, and specialty processors. Appliance 1290 may act as a gateway, a proxy, or a translator between server 1240 and network 1260.

Cloud-based compute system 1295 can include any type of networked computing devices (e.g., a federation of homogeneous or heterogeneous storage devices) that together provide computing and data storage capabilities to one or more servers and/or clients.

Note that different embodiments of the present invention may use different system configurations, and are not limited to the system configuration illustrated in computing environment 1200. In general, any device that includes computational and storage capabilities may incorporate elements of the present invention.

Figure 13:
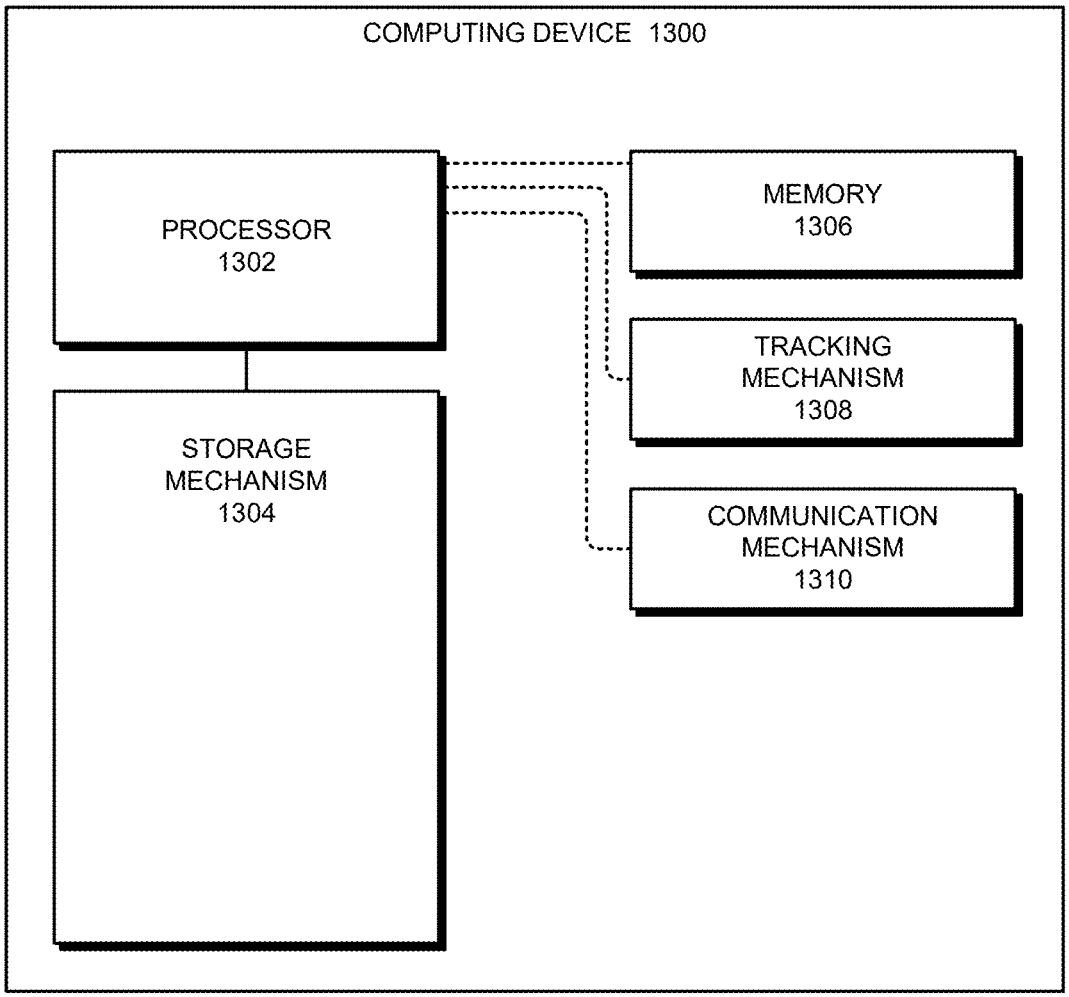
FIG. 13 illustrates a computing device in accordance with an embodiment.

FIG. 13 illustrates a computing device 1300 that includes a processor 1302 and a storage mechanism 1304. Computing device 1300 also includes a memory 1306, a tracking mechanism 1308, and a communication mechanism 1310.

In some embodiments, computing device 1300 uses processor 1302, memory 1306, tracking mechanism 1308, communication mechanism 1310, and storage mechanism 1304 to perform functions that facilitate reducing the energy used by a hybrid space-conditioning system (HSCS). For instance, computing device 1300 can use processor 1302 and/or tracking mechanism 1308 to track the operation of HSCS components, and store such tracking information as well as information describing the characteristics of HSCS components, the execution state of computing device 1300 and configuration, forecast, and prediction data in memory 1306 and/or storage mechanism 1304. Program instructions executing on processor 1302 can determine and communicate commands for HSCS components and/or request data and/or external analysis of stored data using communication mechanism 1310, and analyze the operation of the HSCS. Note that in some embodiments, processor 1302 supports executing multiple different lightweight services in a single VM using docker containers.

In some embodiments of the present invention, some or all aspects of memory 1306, tracking mechanism 1308, communication mechanism 1310, and/or storage mechanism 1304 can be implemented as dedicated hardware modules in computing device 1300. These hardware modules can include, but are not limited to, processor chips, application-specific integrated circuit (ASIC) chips, field-programmable gate arrays (FPGAs), memory chips, and other programmable-logic devices now known or later developed.

Processor 1302 can include one or more specialized circuits for performing the operations of the mechanisms. Alternatively, some or all of the operations of memory 1306, tracking mechanism 1308, communication mechanism 1310, and/or storage mechanism 1304 may be performed using general-purpose circuits in processor 1302 that are configured using processor instructions. Thus, while FIG. 13 illustrates tracking mechanism 1308, memory 1306, communication mechanism 1310, and/or storage mechanism 1304 as being external to processor 1302, in alternative embodiments some or all of these mechanisms can be internal to processor 1302.

In these embodiments, when the external hardware modules are activated, the hardware modules perform the methods and processes included within the hardware modules. For example, in some embodiments of the present invention, the hardware module includes one or more dedicated circuits for performing the operations described above. As another example, in some embodiments of the present invention, the hardware module is a general-purpose computational circuit (e.g., a microprocessor or an ASIC), and when the hardware module is activated, the hardware module executes program code (e.g., BIOS, firmware, etc.) that configures the general-purpose circuits to perform the operations described above.

The foregoing descriptions of various embodiments have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A computer-implemented method for controlling a hybrid space-conditioning system (HSCS), wherein the HSCS comprises a two-phase fluid circuit and an energy-exchange resource connected in parallel to the two-phase fluid circuit, the method comprising:

tracking operating characteristics for the two-phase fluid circuit and the energy-exchange resource;

receiving a temperature forecast for a subsequent time interval;

using the tracked operating characteristics and the temperature forecast to determine a predicted watt usage for the subsequent time interval and a beneficial time interval in the subsequent time interval during which the two-phase fluid circuit is predicted to operate with high efficiency;

using the two-phase fluid circuit to charge the energy-exchange resource during the beneficial time interval;

reducing the watts used by the HSCS by leveraging the charged-energy-exchange resource during an inefficient interval in the subsequent time interval during which the two-phase fluid circuit is predicted to operate inefficiently.

2. The computer-implemented method of claim 1, wherein the energy-exchange resource comprises at least one of an energy source or an energy sink added on as a retrofit to a previously-installed system comprising the two-phase fluid circuit and a host thermostat;

wherein the HSCS further comprises a control system that tracks and overrides operating signals of the host thermostat and the two-phase fluid circuit to integrate and leverage capabilities of the energy-exchange resource, thereby reducing watts used by the two-phase fluid circuit; and wherein the control system and the energy-exchange resource facilitate improving energy efficiency of the HSCS by reducing watts used by the two-phase fluid circuit during the inefficient interval, which is a time-frame in which the control system predicts the two-phase fluid circuit would otherwise operate at the least efficient operating condition in the subsequent time interval.

3. The computer-implemented method of claim 2, wherein the two-phase fluid circuit comprises at least one of a bi-directional heat-pump system and a unidirectional air-conditioning system, and;

wherein charging the energy-exchange resource during the beneficial time interval comprises charging the energy-exchange resource using an air-centric circuit of the two-phase fluid circuit in a timeframe in which the two-phase fluid circuit would otherwise not run to take advantage of a favorable ambient-air temperature that facilitates low-watt charging of the energy-exchange resource.

4. The computer-implemented method of claim 3, wherein the method further comprises:

tracking and analyzing the operating parameters of a compressor and an external heat-exchange coil in the two-phase fluid circuit by:

measuring a temperature difference between the inlet and the outlet of the compressor to determine operation and direction; and measuring a temperature for an external heat-exchange coil to determine the watts being consumed;

comparing a set of parameters and specifications for the compressor and the external heat-exchange coil to determine correctness and efficiency of operation; and comparing the energy used when operating the two-phase fluid circuit with energy used when operating the HSCS leveraging the charged energy-exchange resource.

5. The computer-implemented method of claim 2, wherein the control system further comprises one or more sensors that track an internal temperature of a structure being climate-conditioned by the HSCS, an external air temperature for a compressor of the two-phase fluid circuit, and a third temperature of the energy-exchange resource; and wherein the control system uses the internal temperature, the external air temperature, the third temperature, the tracked operating characteristics and the temperature forecast to determine when to leverage the energy-exchange resource as an alternate temperature sink for an air-centric temperature sink that is used by the two-phase fluid circuit.

6. The computer-implemented method of claim 5, wherein the tracked operating characteristics for the two-phase fluid circuit and the energy-exchange resource are determined by a watt usage of the HSCS when operating using the air-centric temperature sink across a range of temperatures and when operating using the energy-exchange resource as the alternate temperature sink across a range of states for the energy-exchange resource; and an additional overhead and a wattage cost associated with charging and accessing the energy-exchange resource; and wherein leveraging the energy-exchange resource further comprises determining that the wattage reductions associated with using the energy-exchange resource outweigh the additional overhead and the wattage cost.

7. The computer-implemented method of claim 6, wherein determining the watt usage of the HSCS further comprises:

receiving a manufacturer performance curve describing the efficiency of the two-phase fluid circuit across a range of operating conditions; and comparing the manufacturer performance curve with the tracked operating characteristics for the two-phase fluid circuit to adjust the manufacturer performance curve to a specific environment of the structure;

receiving a set of characteristics describing the energy-exchange resource; and comparing the set of characteristics with the tracked operating characteristics for the energy-exchange resource to model the energy-exchange resource in the specific environment of the structure.

8. The computer-implemented method of claim 7, wherein the method further comprises:

tracking the watt usage and the tracked operating characteristics of components of the HSCS;

comparing operating characteristics of components of the HSCS with received manufacturer performance and specification information to detect unusual component behavior that may lead to system damage;

flagging an alert to a user of potential issues for the HSCS; and operating the HSCS in a default mode of the previously-installed system and the host thermostat to ensure that there is no damage to the previously-installed system and the HSCS.

9. The computer-implemented method of claim 7, wherein reducing the watts used by the HSCS further comprises analyzing the temperature forecast for the subsequent time interval, the adjusted manufacturer performance curve, and the modeled performance of the energy-exchange resource to determine a specific charging interval within the subsequent time interval during which to charge the energy-exchange resource and a specific usage interval within the inefficient interval during which to leverage the energy-exchange resource to minimize the watt usage of the HSCS during the subsequent time interval.

10. The computer-implemented method of claim 6, wherein using the two-phase fluid circuit to charge the energy-exchange resource further comprises:

determining a current thermal capacity and a maximum thermal capacity for the energy-exchange resource;

determining that the current thermal capacity is sufficient for the inefficient interval, but that the current thermal capacity is less than the maximum thermal capacity and that additional charging can be performed during the beneficial time interval;

calculating a likelihood of variation from the temperature forecast based on tracked previous forecasts and actual measured temperatures over past operation; and performing an additional amount of charging of the energy-exchange resource during the beneficial time interval based on the likelihood to further improve efficiency of the HSCS if actual temperatures deviate from the temperature forecast.

11. The computer-implemented method of claim 6, wherein the subsequent time interval is a 24-hour day, and wherein the method further comprises:

determining from the temperature forecast, a climate zone associated with an install location for the HSCS, and a known time and date that the HSCS is operating in a winter season;

determining that the winter season is associated with warmer daytime temperatures and cooler nighttime temperatures that require heating; and warm-charging the energy-exchange resource during the warmest predicted daytime temperatures to minimize watts consumed by an ambient-air-exchange mechanism in the two-phase fluid circuit and then subsequently leveraging the charges-energy-exchange resource as an energy sink to reduce watt usage while using the HSCS to heat the structure during the coldest predicted evening temperatures of the inefficient interval.

12. The computer-implemented method of claim 6, wherein the subsequent time interval is a 24-hour day, wherein the method further comprises:

determining from the temperature forecast, a climate zone associated with an install location for the HSCS, and a known time and date that the HSCS is operating in a summer season;

determining that the summer season is associated with warmer daytime temperatures that require cooling and cooler nighttime and morning temperatures; and cool-charging the energy-exchange resource during at least one of the coolest predicted nighttime and morning temperatures to minimize watts consumed by an ambient-air-exchange mechanism in the two-phase fluid circuit and then subsequently leveraging the charges-energy-exchange resource as an energy sink to reduce watt usage while using the HSCS to cool the structure during the warmest predicted daytime temperatures of the inefficient interval.

13. The computer-implemented method of claim 6, wherein the subsequent time interval is a 24-hour day, wherein the method further comprises:

determining from the temperature forecast, a climate zone associated with an install location for the HSCS, and a known time and date that the HSCS is operating in a shoulder season;

determining expected temperature values for the subsequent time interval from the temperature forecast to determine predicted daytime and nighttime temperatures;

determining a current state of the energy-exchange resource;

determining from the predicted temperatures at least one of heating or cooling needs for the structure over the subsequent time interval; and using the current state to calculate and compare watt usage benefits of warm-charging the energy-exchange resource versus cool-charging the energy-exchange resource for the subsequent time interval; and using the comparison to determine a charging direction and to select the corresponding beneficial time interval and the inefficient interval to charge and use the energy-exchange resource to minimize the watt usage of the HSCS over the subsequent time interval;

wherein during the shoulder season the charging direction for the energy-exchange resource is determined on a daily basis based on the current state and predicted conditions.

14. The computer-implemented method of claim 6, wherein the subsequent time interval is a multi-day interval, wherein the method further comprises:

using the temperature forecast to determine multi-day temperature trends for the subsequent time interval;

using the tracked operating characteristics for the energy-exchange resource and the set of characteristics describing the energy-exchange resource to model an energy loss for the energy-exchange resource over the multi-day interval; and upon determining that the watt reduction benefits of pre-charging the energy-exchange resource are larger than the energy loss, pre-charging the energy-exchange resource to reduce wattage usage for the HSCS over multiple subsequent days.

15. The computer-implemented method of claim 2, wherein the tracking and the overriding of the operating signals of the host thermostat comprises:

tracking one or more external sensors that indirectly detect signals sent from and received by the host thermostat; and adjusting a charging operation for the energy-exchange resource in response to a requested operation detected via tracking the host thermostat.

16. A non-transitory computer-readable storage medium storing instructions that when executed by a computing device cause the computing device to perform a method for controlling a hybrid space-conditioning system (HSCS), wherein the HSCS comprises a two-phase fluid circuit and an energy-exchange resource connected in parallel to the two-phase fluid circuit, the method comprising:

tracking operating characteristics for the two-phase fluid circuit and the energy-exchange resource;

receiving a temperature forecast for a subsequent time interval;

using the tracked operating characteristics and the temperature forecast to determine a predicted watt usage for the subsequent time interval and a beneficial time interval in the subsequent time interval during which the two-phase fluid circuit is predicted to operate with high efficiency but not be fully utilized by the HSCS;

using the two-phase fluid circuit to charge the energy-exchange resource during the beneficial time interval;

reducing watts used by the HSCS by leveraging the energy-exchange resource during an inefficient interval in the subsequent time interval during which the two-phase fluid circuit is predicted to operate inefficiently.

17. A computing device that controls a hybrid space-conditioning system (HSCS), wherein the HSCS comprises a two-phase fluid circuit and an energy-exchange resource connected in parallel to the two-phase fluid circuit, comprising:

a processor;

a tracking mechanism;

a communication mechanism;

a storage mechanism; and a memory;

wherein the tracking mechanism is configured to:

track and store operating characteristics for the two-phase fluid circuit and the energy-exchange resource in the storage mechanism;

store in the storage mechanism a temperature forecast received for a subsequent time interval;

use the processor to analyze the tracked operating characteristics and the temperature forecast to determine a predicted watt usage for the subsequent time interval and a beneficial time interval in the subsequent time interval during which the two-phase fluid circuit is predicted to operate with high efficiency but not be fully utilized by the HSCS;

control the two-phase fluid circuit to charge the energy-exchange resource during the beneficial time interval;

reduce watts used by the HSCS using the communication mechanism to communicate commands to the HSCS to leverage the energy-exchange resource during an inefficient interval in the subsequent time interval in which the two-phase fluid circuit is predicted to operate inefficiently.

* * * * *